US009661436B2

(12) United States Patent
Sato et al.

(10) Patent No.: US 9,661,436 B2
(45) Date of Patent: May 23, 2017

(54) AUDIO SIGNAL PLAYBACK DEVICE, METHOD, AND RECORDING MEDIUM

(71) Applicant: Sharp Kabushiki Kaisha, Osaka-shi, Osaka (JP)

(72) Inventors: Junsei Sato, Osaka (JP); Hisao Hattori, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 131 days.

(21) Appl. No.: 14/423,767

(22) PCT Filed: Aug. 23, 2013

(86) PCT No.: PCT/JP2013/072545
§ 371 (c)(1),
(2) Date: Feb. 25, 2015

(87) PCT Pub. No.: WO2014/034555
PCT Pub. Date: Mar. 6, 2014

(65) Prior Publication Data

US 2015/0215721 A1 Jul. 30, 2015

(30) Foreign Application Priority Data

Aug. 29, 2012 (JP) ..... 2012-188496

(51) Int. Cl.
*H04S 5/00* (2006.01)
*H04S 3/00* (2006.01)
*H04S 7/00* (2006.01)

(52) U.S. Cl.
CPC ..... *H04S 5/005* (2013.01); *H04S 3/002* (2013.01); *H04S 7/30* (2013.01); *H04S 7/307* (2013.01);
(Continued)

(58) Field of Classification Search
None
See application file for complete search history.

(56) References Cited

U.S. PATENT DOCUMENTS

2005/0175197 A1 8/2005 Melchior et al.
2007/0110268 A1* 5/2007 Konagai ..... H04R 3/12 381/335
(Continued)

FOREIGN PATENT DOCUMENTS

JP 2006-507727 A 3/2006
JP 2009-071406 A 4/2009
(Continued)

OTHER PUBLICATIONS

Greensted, Andrew. "Delay Calculations." Sep. 2, 2010. pp. 1-4. http://www.labbookpages.co.uk/audio/beamforming/delayCalc.html.*
(Continued)

*Primary Examiner* — Curtis Kuntz
*Assistant Examiner* — Qin Zhu
(74) *Attorney, Agent, or Firm* — Keating & Bennett, LLP

(57) ABSTRACT

An audio signal playback device includes a conversion unit that performs discrete Fourier transform on each of 2 channel audio signals obtained from a multi-channel input audio signal, a correlation signal extraction unit that, disregarding a direct current component, extracts a correlation signal from the 2 channel audio signals that result from the discrete Fourier transform, and additionally pulls a correlation signal in a lower frequency than a predetermined frequency $f_{low}$ out of the correlation signal, and an output unit that allocates the pulled-out correlation signal to a virtual sound source in such a manner that a time difference in a sound output between adjacent speakers falls within a range of $2\Delta x/c$ (where, $\Delta x$ is a distance between the adjacent speakers, and c is the speed of sound), and outputs a result of the allocation from one portion or all portions of the speaker group.

12 Claims, 15 Drawing Sheets

(52) U.S. Cl.
CPC ..... *H04R 2499/15* (2013.01); *H04S 2400/01* (2013.01); *H04S 2400/07* (2013.01); *H04S 2400/11* (2013.01); *H04S 2420/05* (2013.01); *H04S 2420/07* (2013.01); *H04S 2420/13* (2013.01)

(56) References Cited

U.S. PATENT DOCUMENTS

| | | | | |
|---|---|---|---|---|
| 2009/0225992 | A1 | 9/2009 | Konagai | |
| 2012/0121093 | A1 * | 5/2012 | Araki | H04R 3/14 381/17 |

FOREIGN PATENT DOCUMENTS

| | | | | |
|---|---|---|---|---|
| JP | 2009-212890 | A | 9/2009 | |
| JP | 4810621 | B1 | 11/2011 | |
| JP | 2012-034295 | A | 2/2012 | |
| KR | WO 2007091842 | A1 * | 8/2007 | G10L 19/008 |
| WO | 2004/047485 | A1 | 6/2004 | |
| WO | 2012/032845 | A1 | 3/2012 | |

OTHER PUBLICATIONS

Official Communication issued in International Patent Application No. PCT/JP2013/072545, mailed on Sep. 17, 2013.
Berkhout et al., "Acoustic Control by Wave Field Synthesis," J. Acoust. Soc. Am. 93 (5), May 1993, pp. 2764-2778.

* cited by examiner

AUDIO SIGNAL PLAYBACK DEVICE, METHOD, AND RECORDING MEDIUM

TECHNICAL FIELD

The present invention relates to an audio signal playback device that plays back a multi-channel audio signal with a speaker group, a method, a program, and a recording medium.

BACKGROUND ART

As a sound playback type that is proposed in the related art, a stereo (2 channel) type, a 5.1 channel surround type (ITU-R BS.775-1) and the like are widely popular for consumer use. The 2 channel type, as schematically illustrated in FIG. 1, is a type in which pieces of different audio data are generated from a left speaker 11L and a right speaker 11R. The 5.1 channel surround type, as schematically illustrated in FIG. 2, is a type in which pieces of different audio data are input into a left front speaker 21L, a right front speaker 21R, a center speaker 22C that is arranged between the left front speaker 21L and the right front speaker 21R, a left rear speaker 23L, a right rear speaker 23R, and a subwoofer dedicated to a low frequency (generally 20 Hz to 100 Hz) (not shown) for output.

Furthermore, in addition to the 2 channel type and the 5.1 channel surround type, various sound playback types are proposed such as a 7.1 channel type, a 9.1 channel type, and a 22.2 channel type. According to any of the types described above, speakers are circularly or spherically arranged around a hearer (a listener), and ideally it is desirable that the listener listens to audio at a listening position (hearing position), a so-called sweet spot, which is equally distant from the speakers. For example, it is desirable that in the 2 channel type, the listener listens to audio at the sweet spot 12 and that in the 5.1 channel surround type, the listener listens to audio at the sweet spot 24. When the listener listens to audio at the sweet spot, a synthetic sound image resulting from sound pressure balance is localized at a manufacturer-intended place. Otherwise, when the listener listens to audio at places other than the sweet spot, generally, a sound image•sound quality deteriorates. These types are hereinafter collectively referred to as a multi-channel playback type.

On the other hand, aside from the multi-channel playback type, there is a sound source object-oriented playback type. The type is a type in which all sound is set to be sound that is generated by any sound source object, and each sound source object (which is hereinafter referred to as a "virtual sound source") includes its own positional information and audio signal. In an example of music content, each virtual sound source includes sound of each musical instrument and positional information on a position at which the musical instrument is arranged.

Then, the sound source object-oriented playback type is a playback type (that is, a wavefront synthesis playback type) in which wavefronts of sound are synthesized, by a group of speakers that are arranged side by side in a linear or planar manner. Among these wavefront synthesis playback types, in recent years, a wave field synthesis (WFS) type disclosed in NPL 1 has been actively studied as one realistic implementation method that uses a group of speakers (hereinafter referred to as a speaker array) that are arranged side by side in a linear manner.

This wavefront synthesis playback type is different from the multi-channel playback type described above, and has characteristics that provide both good sound image and sound quality at the same time to a listener who listens to audio at any position before a group 31 of speakers that are arranged side by side, as schematically illustrated in FIG. 3. To be more precise, a sweet spot 32 in the wavefront synthesis playback type is wide as illustrated.

Furthermore, the listener who faces the speaker array and listens to audio in a sound space that is provided by the WFS type feels as if sound that is actually emitted from the speaker array was emitted from a sound source (a virtual sound source) that is virtually present in rear of the speaker array.

In the wavefront synthesis playback type, an input signal indicating the virtual sound source is set to be necessary. Then, generally, it is necessary that an audio signal for one channel and positional information on a virtual sound source are included in one virtual sound source. In the example of music content described above, for example, an audio signal that is recorded for each musical instrument and positional information on the musical instrument are included. However, the audio signal for each virtual sound source is not necessary for each musical instrument, but there is a need to express an arrival direction and volume of each piece of sound that are intended by a content manufacturer, using a concept called a virtual sound source.

At this point, because the most widely popular of the multi-channel types described above is a stereo (2 channels) type, stereo-type music content is considered. L (left) channel and R (right) channel audio signals in the stereo-type music content are played back through a speaker 41L installed to the left and a speaker 41R installed to the right using two speakers 41L and 41R as illustrated in FIG. 4. When the playback is performed in this manner, as illustrated in FIG. 4, only in a case where the listener listens to audio at a point that is equally distant from the speaker 41L and the speaker 41R, that is, at a sweet spot 43, vocal voice and bass sound are heard from a middle position 42*b*, piano sound is heard from a left-side position 42*a*, drum sound is heard from a right-side position 42*c*, and so forth. Thus, the sound image is localized and is heard as intended by the manufacturer.

It is considered that such content is played back using the wavefront synthesis playback type, and that the localization of the sound image as intended by the content manufacturer, which is a characteristic of the wavefront synthesis playback type, is provided to the listener at any position. To do so, as at a sweet spot 53 that is illustrated in FIG. 5, such a sound image as when heard within the sweet spot 43 in FIG. 4, has to be heard from any listening position. To be more precise, the vocal voice and the bass sound are heard from a middle position 52*b*, the piano sound is heard from a left-side position 52*a*, the drum sound is heard from a right-side position 52*c*, and so forth at the wide sweet spot 53 through a group 51 of speakers that are arranged side by side in a linear or planar manner. Thus, the sound image as intended by the manufacturer has to be localized and heard.

To solve such a problem, for example, a case is considered where an L channel sound and an R channel sound are arranged as virtual sound sources 62*a* and 62*b*, respectively, as illustrated in FIG. 6. In this case, because each of the L/R channels, as a single unit, does not indicate one sound source, but a synthetic sound image is generated by the two channels, although such a result is played back using the wavefront synthesis playback type, a sweet spot 63 is generated too, and the sound image is localized only at a sweet spot 63, as illustrated in FIG. 4. To be more precise, in order to realize the sound image localization, there is a need for separation into audio for each sound image from 2 channel stereo data by any means, and for generation of virtual sound source data from each piece of audio.

To solve the problems, in a method disclosed in PTL 1, 2 channel stereo data is separated into a correlation signal and a non-correlation signal based on a correlation coefficient of signal power for each frequency band, a synthetic sound image direction for the correlation signal is estimated, and a virtual sound source is generated from a result of the estimation, and is played back using the wavefront synthesis playback type and the like.

CITATION LIST

Patent Literature

PTL 1: Japanese Patent No. 4810621

Non Patent Literature

NPL 1: A. J. Berkhout, D. de Vries, and P. Vogel, "Acoustic control by wave field synthesis", J. Acoust. Soc. Am. Volume 93(5), U.S.A., Acoustical Society of America, May 1993, pp. 2764-2778

SUMMARY OF INVENTION

Technical Problem

However, in a case where the wavefront synthesis playback type described above is applied to an actual product such as a television apparatus or a sound bar, low cost or good-quality design is accomplished. A reduction in the number of speakers is important in terms of decreasing cost, and a decrease in the height of a speaker array by making the speaker small in diameter is important in terms of design. In this situation, when the method disclosed in PTL 1 is applied, in a case where the number of speakers is small or the speaker is small in diameter, because a total area of the speaker is small, particularly, sound pressure of a low frequency band is insufficient and a lively realistic feeling is not obtained.

An object of the present invention, which is made in view of the situation described above, is to provide an audio signal playback device that is capable of faithfully realizing a sound image at any listening position, and also of preventing sound in a low frequency band from falling short of sound pressure in a case where the audio signal is played back using a wavefront synthesis playback type by a speaker group subject to low-cost restriction, such as when each channel is equipped with only a small-capacity amplifier in speakers of which the number is small or in small-diameter speakers, a method, a program, and a recording medium.

Solution to Problem

In order to solve the problem described above, according to first technological means of the present invention, there is provided an audio signal playback device that plays back a multi-channel input audio signal with a speaker group using a wavefront synthesis playback type, the device including: a conversion unit that performs discrete Fourier transform on each of 2 channel audio signals obtained from the multi-channel input audio signal; a correlation signal extraction unit that, disregarding a direct current component, extracts a correlation signal from the 2 channel audio signals that result from the discrete Fourier transform by the conversion unit, and additionally pulls a correlation signal in a lower frequency than a predetermined frequency $f_{low}$ out of the correlation signal; and an output unit that outputs the correlation signal pulled out in the correlation signal extraction unit from one portion or all portions of the speaker group in such a manner that a time difference in a sound output between adjacent speakers that are output destinations falls within a range of $2\Delta x/c$ (here, $\Delta x$ is set to be a distance between the adjacent speakers, and c is a sound speed).

According to second technological means of the present invention, in the first technological means, the output unit may allocate the correlation signal pulled out in the correlation signal extraction unit to one virtual sound source and output a result of the allocation from the one portion or all the portions of the speaker group using the wavefront synthesis playback type.

According to third technological means of the present invention, in the first technological means, the output unit may output the correlation signal pulled out in the correlation signal extraction unit, in the form of a plane wave, from the one portion or all the portions of the speaker group, using the wavefront synthesis playback type.

According to fourth technical means of the present invention, in any one of the first to third technological means, the multi-channel input audio signal may be a multi-channel playback type of input audio signal, which has 3 or more channels, and the conversion unit may perform the discrete Fourier transform on the 2 channel audio signals that result from down-mixing the multi-channel input audio signal to the 2 channel audio signals.

According to fifth technological means of the present invention, there is provided an audio signal playback method of playing back a multi-channel input audio signal with a speaker group using a wavefront synthesis playback type, the method including: a conversion step of causing a conversion unit to perform discrete Fourier transform on each of 2 channel audio signals obtained from the multi-channel input audio signal; an extraction step of causing a correlation signal extraction unit to extract a correlation signal from the 2 channel audio signals that result from the discrete Fourier transform in the conversion step, disregarding a direct current component, and additionally to pull the correlation signal in a lower frequency than a predetermined frequency $f_{low}$ out of the correlation signal; and an output step of causing an output unit to output the correlation signal pulled out in the extraction step from one portion or all portions of the speaker group in such a manner that a time difference in a sound output between adjacent speakers that are output destinations falls within a range of $2\Delta x/c$ (here, $\Delta x$ is set to be a distance between the adjacent speakers, and c is a sound speed).

According to sixth technological means of the present invention, there is provided a program for causing a computer to perform audio signal playback processing that plays back a multi-channel input audio signal with a speaker group using a wavefront synthesis playback type, the computer being caused to perform; a conversion step of performing discrete Fourier transform on each of 2 channel audio signals obtained from the multi-channel input audio signal; an extraction step of extracting a correlation signal from the 2 channel audio signals that result from the discrete Fourier transform in the conversion step, disregarding a direct current component, and additionally to pull the correlation signal in a lower frequency than a predetermined frequency $f_{low}$ out of the correlation signal; and an output step of outputting the correlation signal pulled out in the extraction step from one portion or all portions of the speaker group in such a manner that a time difference in a sound output between adjacent speakers that are output destinations falls within a range of $2\Delta x/c$ (here, $\Delta x$ is set to be a distance between the adjacent speakers, and c is a sound speed).

According to seventh technological means of the present invention, there is provided a computer-readable recording medium on which the program according to the sixth technological means is recorded.

Advantageous Effects of Invention

According to the present invention, it is possible to faithfully realize a sound image at any listening position, and also to prevent sound in a low frequency band from falling short of sound pressure in a case where the audio signal is played back using a wavefront synthesis playback type by a speaker group subject to low-cost restriction, such as when each channel is equipped with only a small-capacity amplifier in speakers of which the number is small or in small-diameter speakers.

DESCRIPTION OF EMBODIMENTS

Figure 1:
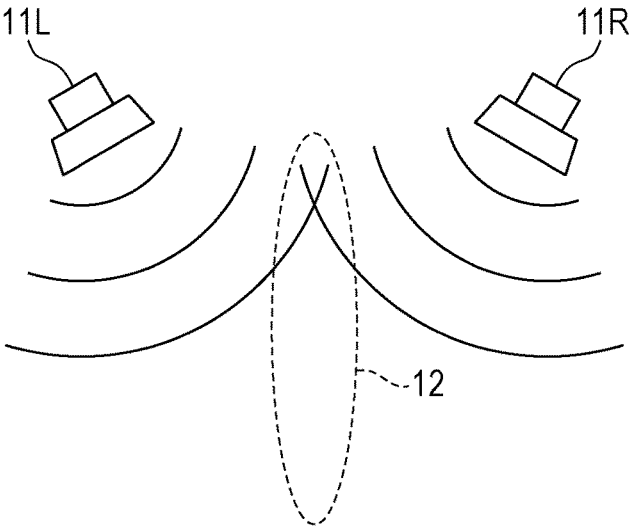
FIG. 1 is a schematic diagram for describing a 2 channel type.
Figure 2:
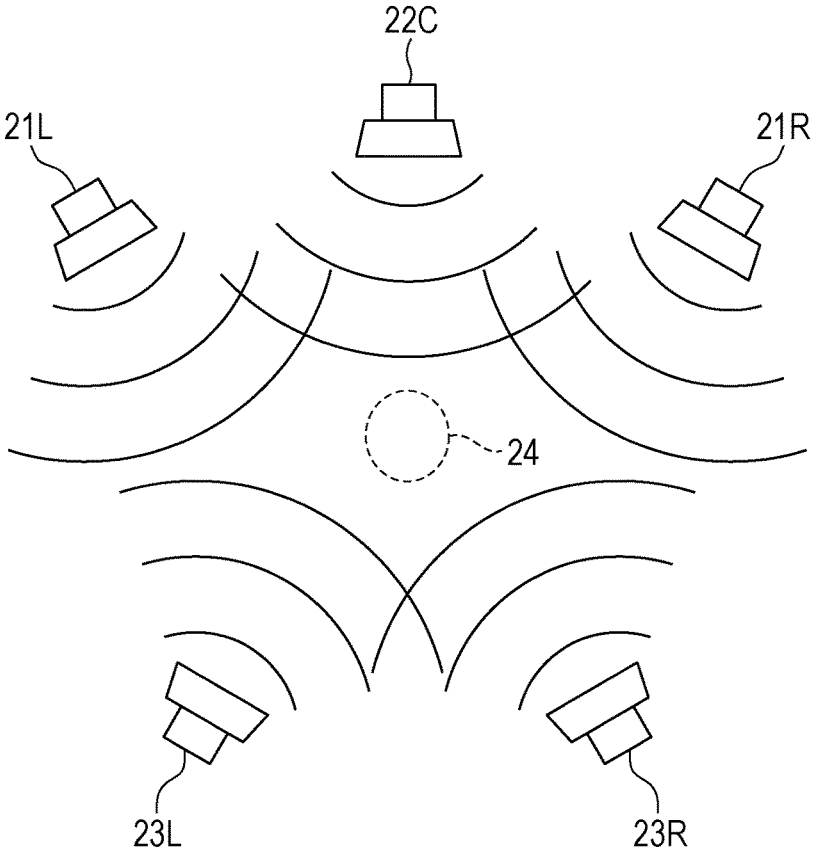
FIG. 2 is a schematic diagram for describing a 5.1 channel surround type.
Figure 3:
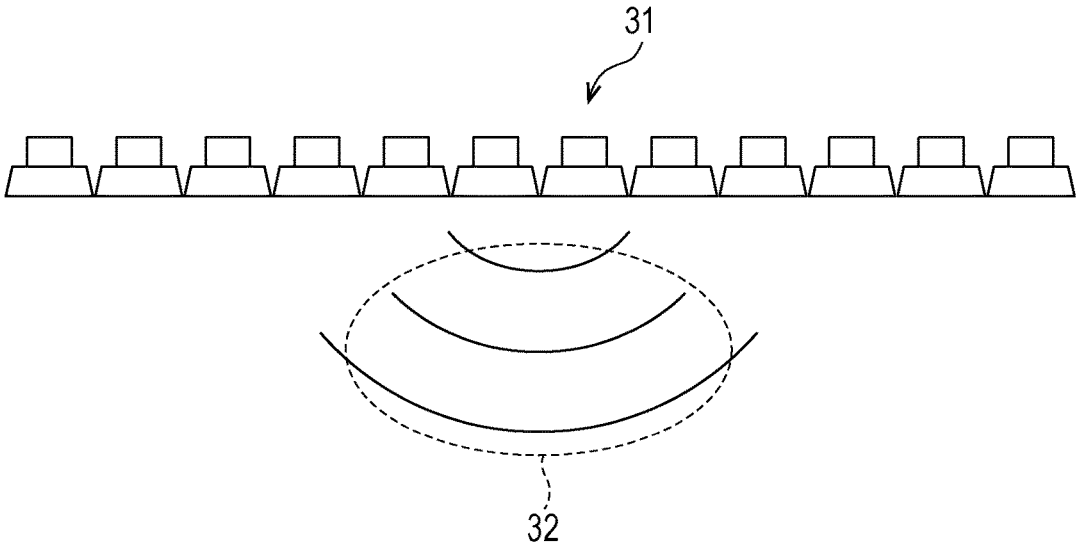
FIG. 3 is a schematic diagram for describing a wavefront synthesis playback type.
Figure 4:
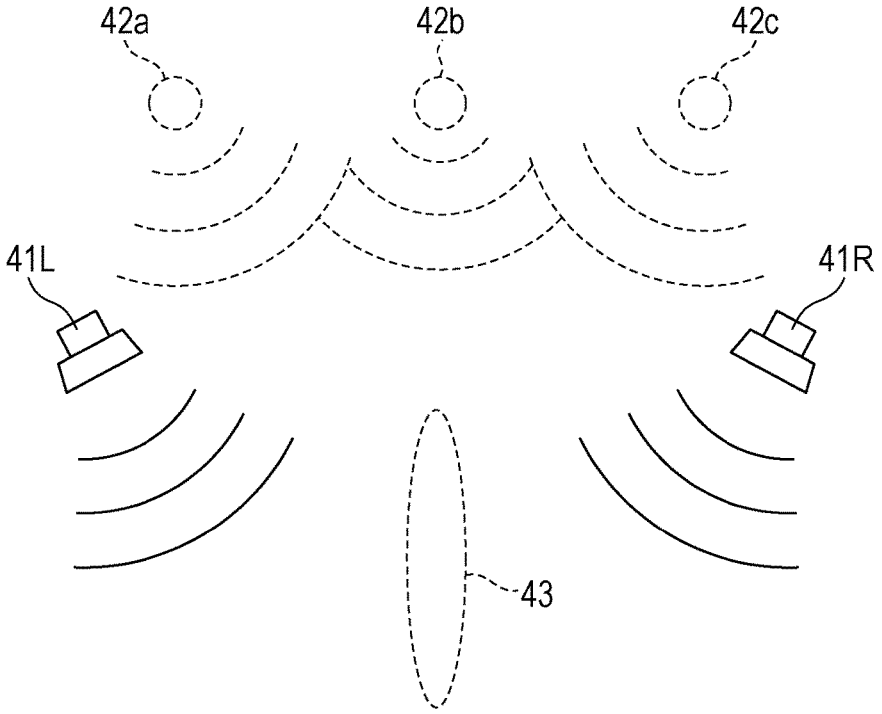
FIG. 4 is a schematic diagram illustrating a situation in which music content in which vocal sound, bass sound, piano sound, and drum sound are recorded in a stereo type is played back using two speakers: a left speaker and a right speaker.
Figure 5:
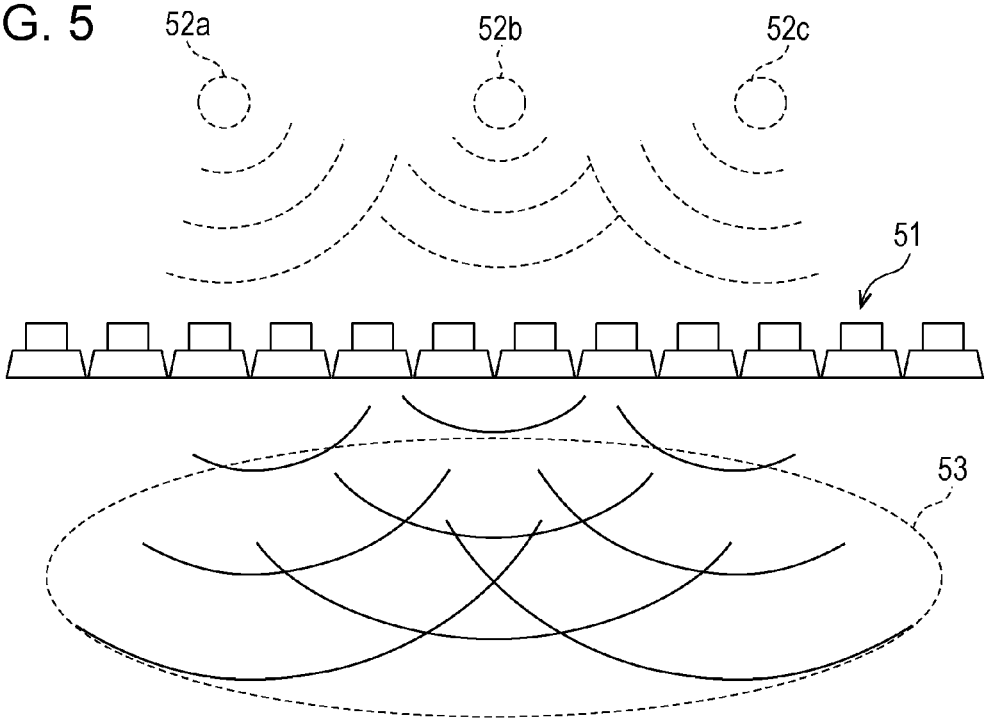
FIG. 5 is a schematic diagram illustrating an aspect of an ideal sweet spot that appears when playing back the music content in FIG. 4 using a wavefront synthesis playback type.
Figure 6:
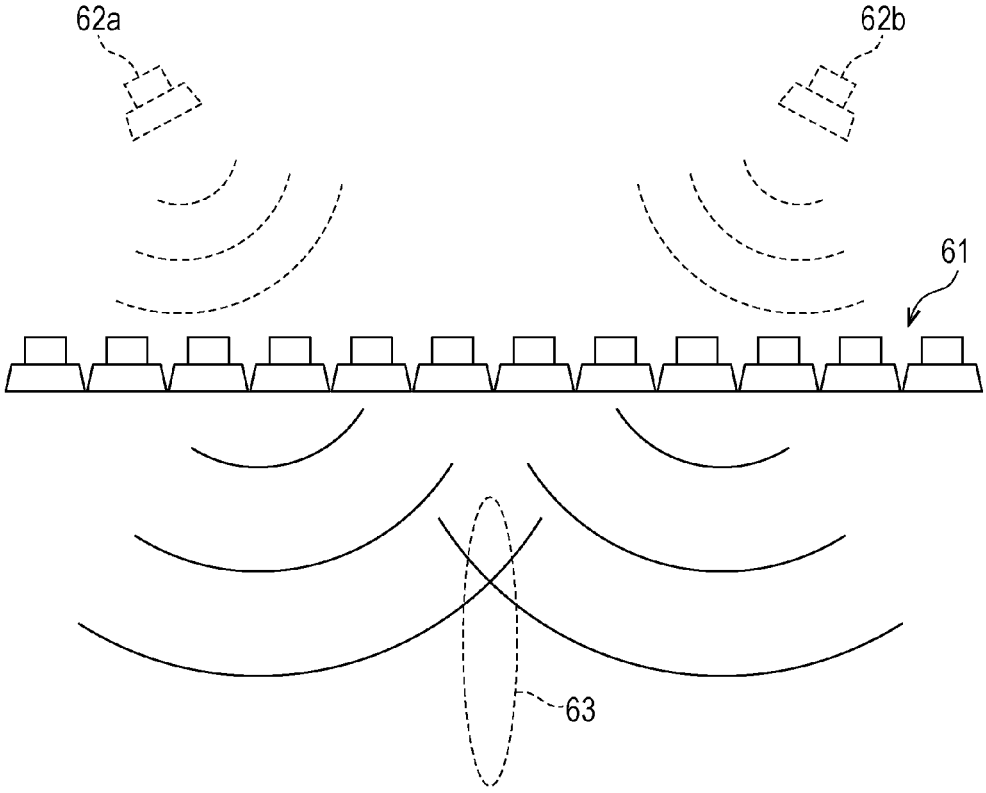
FIG. 6 is a schematic diagram illustrating an aspect of an actual sweet spot that appears when playing back left/right channel audio signals in the music content in FIG. 4 using the wavefront synthesis playback type, with a virtual sound source being set to be at positions of left/right speakers.

An audio signal playback device according to the present invention is a device that is capable of playing back a multi-channel input audio signal such as a multi-channel playback type of audio signal, using a wavefront synthesis playback type, and is also referred to as an audio data playback device or a wavefront synthesis playback device. Moreover, an audio signal, of course, is not limited to a signal onto which so-called audio is modulated, and is also referred to as an acoustic signal. Furthermore, the wavefront synthesis playback type is a playback type in which wavefronts of sound are synthesized by a group of speakers that are arranged side by side in a linear or planar manner as described above.

A configuration example and a processing example of the audio signal playback device according to the present invention will be described below referring to the drawings. An example will be described below in which the audio signal playback device according to the present invention converts the multi-channel playback type of audio signal and thus generates a wavefront synthesis playback type of audio signal for playback.

Figure 7:
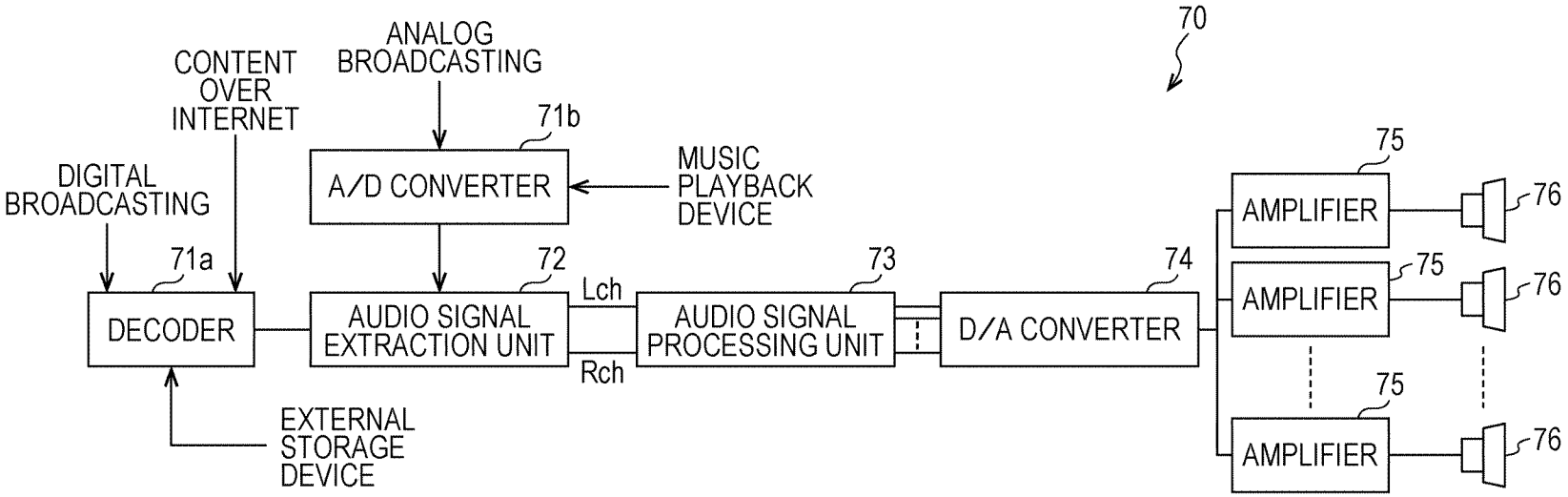
FIG. 7 is a block diagram illustrating one configuration example of an audio signal playback device according to the present invention.
Figure 8:
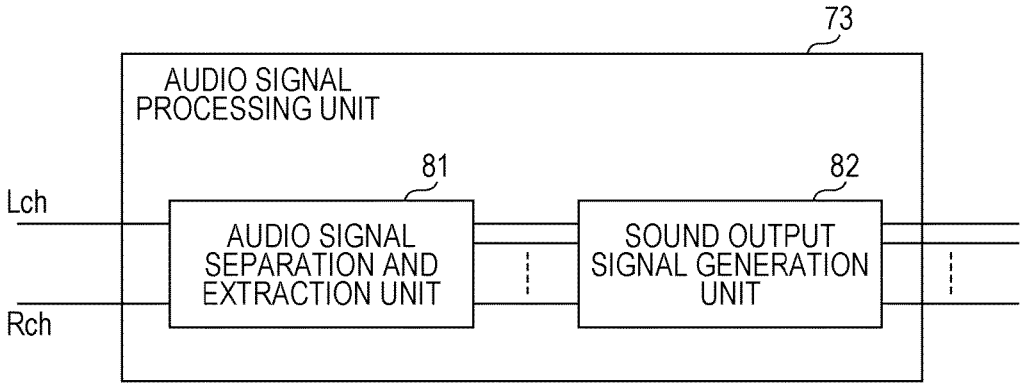
FIG. 8 is a block diagram illustrating one configuration example of an audio signal processing unit of the audio signal playback device in FIG. 7.

FIG. 7 is a block diagram illustrating one configuration example of the audio signal playback device according to the present invention. FIG. 8 is a block diagram illustrating one configuration example of an audio signal processing unit of the audio signal playback device in FIG. 7.

An audio signal playback device 70 that is illustrated in FIG. 7 is configured from a decoder 71*a*, an A/D converter 71*b*, an audio signal extraction unit 72, an audio signal processing unit 73, a D/A converter 74, an amplifier group 75, and a speaker group 76.

The decoder 71*a* decodes only audio or image content with audio, converts a result of the decoding into a format available for signal processing, and outputs a result of the conversion to the audio signal extraction unit 72. The content is digital broadcast content that is transmitted from a broadcasting station, or is content that is obtained by downloading over the Internet from a server that transfers digital content over a network or by reading from a recording medium in an external storage device. The A/D converter 71*b* samples an analog input audio signal, converts a result of the sampling into a digital signal, and outputs the resulting digital signal to the audio signal extraction unit 72. The input audio signal is an analog broadcast signal or a signal that is output from a music playback device.

In this manner, although not illustrated in FIG. 7, the audio signal playback device 70 includes a content input unit into which content including a multi-channel input audio signal is input. The decoder 71*a* decodes digital content that is input here. The A/D converter 71*b* converts analog content that is input here, into digital content. The audio signal extraction unit 72 separates and extracts an audio signal from the obtained signal. Here, this is set to be a 2 channel stereo signal. The 2 channel signal is output to the audio signal processing unit 73.

In a case where the input audio signal is in greater-than-2 channels, such as 5.1 channels, the audio signal extraction unit 72 down-mixes the greater-than-2 channels to 2 channels using a normal down-mix method expressed in Equation (1) that follows, for example, as stipulated in ARIB STD-B21 "Digital Broadcasting Receiver Standards" and outputs the results of the down-mixing to the audio signal processing unit 73.

[Math. 1]

$$L_t = a \times \left(L + \frac{1}{\sqrt{2}} \times C + k_d L_S\right)$$

$$R_t = a \times \left(R + \frac{1}{\sqrt{2}} \times C + k_d R_S\right)$$

In Equation (1), $L_t$ and $R_t$ are left and right channel signals after the down-mix, L, R, C, $L_s$, and $R_s$ are 5.1 channel signals (a front left channel signal, a front right channel signal, a center channel signal, a rear left channel signal, and a rear right channel signal), a is an overload reduction coefficient, for example, $1/\sqrt{2}$, and $k_d$ is a down-mix coefficient, for example, $1/\sqrt{2}$, ½, $1/2\sqrt{2}$, or 0.

In this manner, the multi-channel input audio signal is a multi-channel playback type of input audio signal, which has 3 or more channels. The audio signal processing unit 73 may down-mix the multi-channel input audio signal to 2 channel audio signals, and then may perform processing, such as discrete Fourier transform described below, on the resulting 2 channel audio signals.

The audio signal processing unit 73 generates multi-channel audio signals (described as, as many signals as the number of virtual sound sources, in the following example) that are in 3 or more channels and that are different from an input audio signal, from the obtained 2 channel signals. To be more precise, the input audio signal is converted into a separate multi-channel audio signal. The audio signal processing unit 73 outputs the resulting audio signal to the D/A converter 74. The number of virtual sound sources, if it is a certain number or greater, may be determined in advance without any difference in performance, but the greater the number of virtual sound sources, the more an amount of computing increases. For this reason, it is desirable that the number of virtual sound sources be determined considering performance of a device that is mounted. In an example here, the number of virtual sound sources is set to be 5.

The D/A converter 74 converts the obtained signal into an analog signal, and outputs the analog signal to each amplifier 75. Each amplifier 75 amplifies the analog signal being input and transmits the amplified analog signal to each speaker 76. The amplified analog signal propagates into the air from each speaker 76.

A detailed configuration of the audio signal processing unit 73 in FIG. 7 is illustrated in FIG. 8. The audio signal processing unit 73 is configured from an audio signal separation and extraction unit 81 and a sound output signal generation unit 82.

The audio signal separation and extraction unit 81 reads 2 channel audio signals, multiplies the 2 channel audio signals by a Hann window function, and generates an audio signal corresponding to each virtual sound source from the 2 channel signal. The audio signal separation and extraction unit 81 multiplies the Hann window function two times on the generated audio signal corresponding to each virtual sound source, and thus removes a portion that is perceived to be noise from an obtained audio signal waveform, thereby outputting the noise-removed audio signal to the sound output signal generation unit 82. In this manner, the audio signal separation and extraction unit 81 has a noise removal unit. The sound output signal generation unit 82 generates an output audio signal waveform corresponding to each speaker from the obtained audio signal.

The sound output signal generation unit 82 performs processing such as wavefront synthesis playback processing, and for example, allocates the obtained audio signal for each virtual sound source to each speaker, thereby generating the audio signal for each speaker. The audio signal separation and extraction unit 81 may be responsible for one portion of the wavefront synthesis playback processing.

Figure 9:
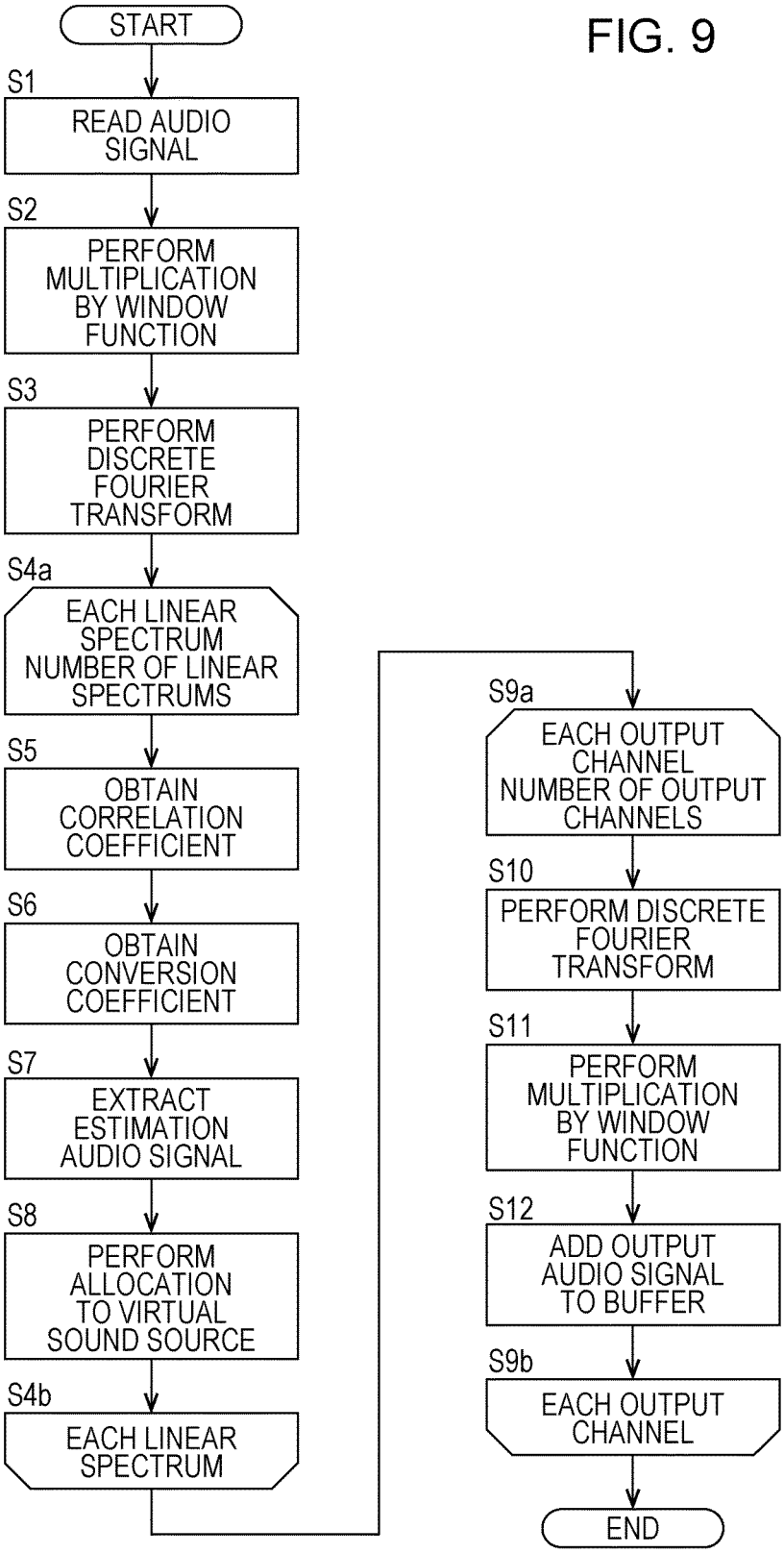
FIG. 9 is a flowchart for describing one example of audio signal processing in the audio signal processing unit in FIG. 8.
Figure 10:
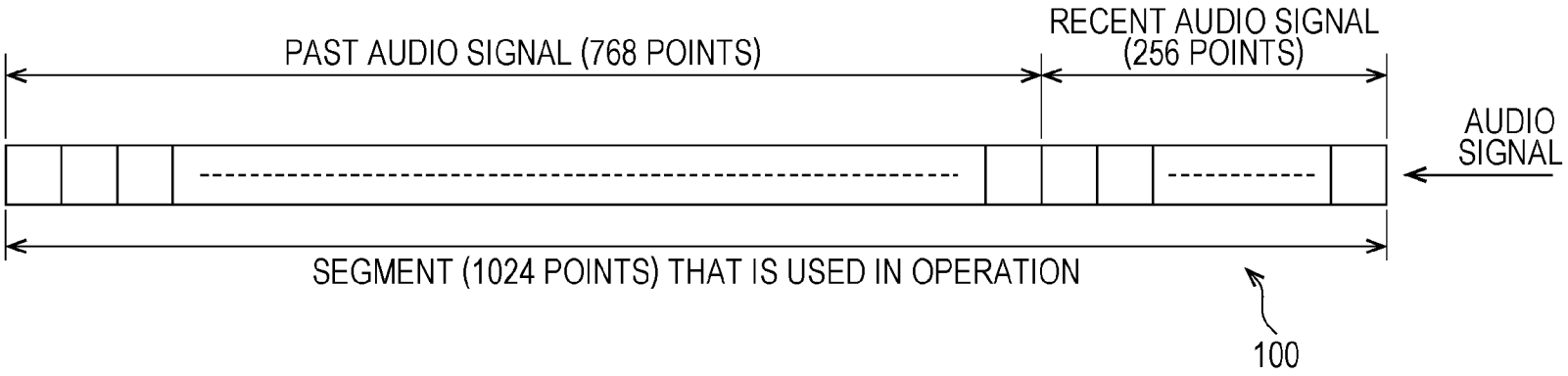
FIG. 10 is a diagram illustrating a situation where audio data is stored in a buffer in the audio signal processing unit in FIG. 8.
Figure 11:
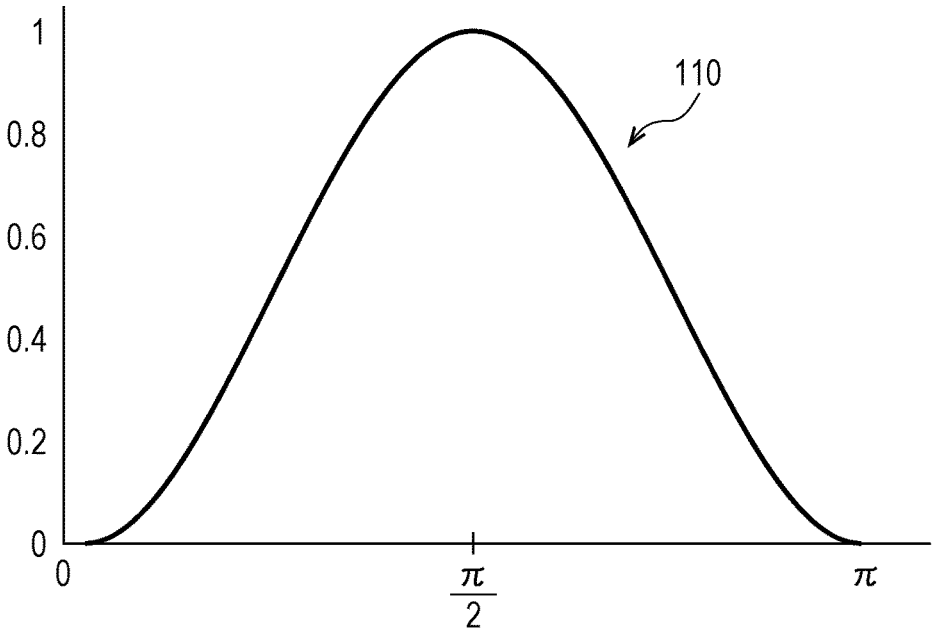
FIG. 11 is a diagram illustrating a Hann window function.
Figure 12:
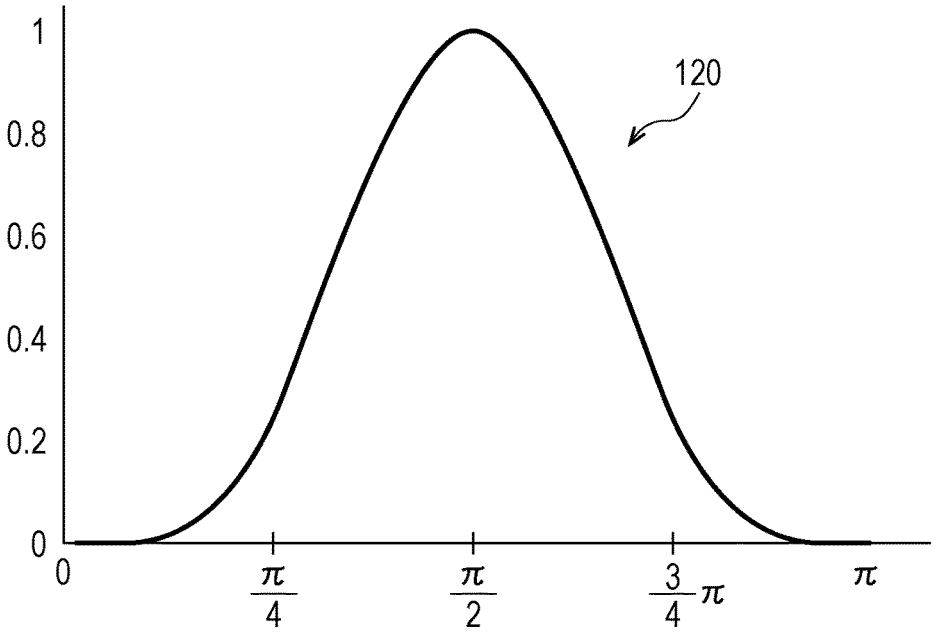
FIG. 12 is a diagram illustrating a window function, multiplication by which is performed one time for every ¼ segment when window function multiplication processing is first performed in the audio signal processing in FIG. 9.

Next, an example of an audio signal processing by the audio signal processing unit 73 is described referring to FIG. 9. FIG. 9 is a block diagram for describing one example of the audio signal processing in the audio signal processing unit in FIG. 8. FIG. 10 is a diagram illustrating a situation where audio data is stored in a buffer in the audio signal processing unit in FIG. 8. FIG. 11 is a diagram illustrating the Hann window function. FIG. 12 is a diagram illustrating a window function, the multiplication by which is performed one time for every ¼ segment when window function multiplication processing is first performed in the audio signal processing in FIG. 9.

First, the audio signal separation and extraction unit 81 of the audio signal processing unit 73 reads audio data of which a length is one-fourth of one segment, from a result of the extraction by the audio signal extraction unit 72 in FIG. 7 (Step S1). Here, the audio data is set to indicate a non-contiguous audio signal waveform that is sampled at a sampling frequency, for example, such as 48 kHz. Then, the segment is an audio data segment that is made from a sampling point group that has a certain length, and is here set to indicate a segment length that is a target for the discrete Fourier transform. The segment is also referred to as a processing segment. A value of the segment is 1024. In this example, 256-point audio data of which a length is one-fourth of one segment is set to be a reading target. Moreover, the segment length that is the reading target is not limited to this, and for example, 512-point audio data of which a length is half of one segment may be read.

The 256-point audio data being read, as illustrated in FIG. 10, is stored in a buffer 100. The buffer has an audio signal waveform corresponding to an immediately-preceding one segment, and segments that exist before that segment are discarded. Data (768 points) corresponding to an immediately-preceding three-fourths of a segment and data (256 points) corresponding to an immediately-succeeding one-fourth of a segment are connected together to create audio data corresponding to one segment, and the process proceeds to perform a window function operation (Step S2). That is, all pieces of sample data are read four times for the window function operation.

Next, the audio signal separation and extraction unit 81 performs window function operation processing that multiplies the audio data corresponding to one segment by the following Hann window that is proposed in the related art (Step S2). The Hann window is illustrated as a window function 110 in FIG. 11.

[Math. 2]

$$w(m) = \sin^2\left(\frac{m}{M}\pi\right) \ (0 \le m < M)$$

In Equation 2, m is a natural number, and M is an even number indicating a length of one segment. When stereo input signals are $x_L(m)$ and $x_R(m)$, respectively, as a result of calculation, audio signals $x'_L(m)$ and $x'_R(m)$ after performing the window function operation are calculated as follows.

$$x'_L(m)=w(m)x_L(m)$$

$$x'_R(m)=w(m)x_R(m) \quad (2)$$

When the Hann window is used, for example, an input signal $x_L(m_0)$ at a sampling point $m_0$ (provided that $0 \le m_0 < M/4$) is multiplied by $\sin^2((m_0/M)\pi)$. Then, when the reading is performed the next time, the same sampling point is read as $m_0+M/4$. When the reading is performed the next time, the same sampling point is read as $m_0+M/2$. When the reading is performed the next time, the same sampling point is read as $m_0+(3M)/4$. Additionally, as described below, the window function is recalculated in the end. Therefore, the input signal $x_L(m_0)$ described above is multiplied by $\sin^4((m_0/M)\pi)$. This, when illustrated as a window function, is a window function 120 that is illustrated in FIG. 12. Because the window function 120 is added four times in total while being shifted for every one-fourth of a segment, multiplication by the following equation is performed.

[Math. 3]

$$\sin^4\left(\frac{m_0}{M}\pi\right) + \sin^4\left(\frac{m_0}{M}\pi + \frac{\pi}{4}\right) + \sin^4\left(\frac{m_0}{M}\pi + \frac{\pi}{2}\right) + \sin^4\left(\frac{m_0}{M}\pi + \frac{3}{4}\pi\right)$$

When this equation is modified, a value is 3/2 (a constant value). For this reason, if, without making any adjustment, the signal being read is multiplied two times by the Hann window, and is multiplied by ⅔, which is a reciprocal number of 3/2, it is shifted by one-fourth of a segment, and the addition is performed (or if the shift by one-fourth of the segment is performed, the addition is performed, and then the multiplication by ⅔ is performed), the original signal is completely restored.

The discrete Fourier transform is performed on the audio data that is obtained in this manner, as in Equation (3) that follows, and the audio data in a frequency domain is obtained (Step S3). Moreover, each processing of Steps S3 to S10 may be performed by the audio signal separation and extraction unit 81. In Equation (3), DFT indicates the discrete Fourier transform, and k is a natural number ($0 \le k < M$). $X_L(k)$ and $X_R(k)$ are complex numbers.

$$X_L(k)=DFT(x'_L(n)),$$

$$X_R(k)=DFT(x'_R(n)) \quad (3)$$

Next, for each linear spectrum, processing in each of Steps S5 to S8 is performed on the obtained audio data in the frequency domain (Steps S4*a* and S4*b*). The individual processing is described in detail. Moreover, an example of processing, such as one that obtains a correlation coefficient for each linear spectrum, is described here, but processing may be performed that obtains the correlation coefficient for every band (small band) that results from division through the use of an equivalent rectangular band (ERB), as disclosed in PTL 1.

At this point, a linear spectrum that results from performing the discrete Fourier transform is symmetrical about M/2 (provided that M is an even number) except for a direct-current component, that is, for example, $X_L(0)$. That is, $X_L(k)$ and $X_L(M-k)$ have a complex conjugate relationship between them, in a range of $0<k<M/2$. Therefore, a range of $k \le M/2$ is considered below an analysis target, and a range of $k>M/2$ is set to be handled in the same manner as the symmetrical linear spectrum that has a complex conjugate relationship.

Next, for each linear spectrum, the correlation coefficient is obtained by obtaining a normalized correlation coefficient between the left channel and the right channel (Step S5).

[Math. 4]

$$d^{(i)} = \frac{D^{(i)}}{G^{(i)}} \quad (4)$$

$$D^{(i)} = |\mathrm{Re}\{X_L(k)\} \cdot \mathrm{Re}\{X_R(k)\}| + |\mathrm{Im}\{X_L(k)\} \cdot \mathrm{Im}\{X_R(k)\}| \quad (5)$$

$$G^{(i)} = \sqrt{P_L^{(i)} P_R^{(i)}} \quad (6)$$

$$P_L^{(i)} = |X_L(k)|^2,\ P_R^{(i)} = |X_R(k)|^2 \quad (7)$$

A normalization correlation coefficient $d^{(i)}$ indicates how much correlation is present between left and right channel audio signals and is a value in a real number from 0 to 1. When all signals are the same, the normalization correlation coefficient $d^{(i)}$ is 1, and when all signals have no correlation between them, the normalization correlation coefficient $d^{(i)}$ is 0. Here, in a case where both power $P_L^{(i)}$ of the left channel audio signal and power $P_R^{(i)}$ of the right channel audio signal are 0, extraction of a correlation signal and a non-correlation signal for such a linear spectrum is set to be impossible, and proceeding to the next processing of the linear spectrum is set to take place, without performing the processing. Furthermore, in a case where one of $P_L^{(i)}$ and $P_R^{(i)}$ is 0, an operation is impossible to perform in Equation (4). However, the normalization correlation coefficient $d^{(i)}$ is set to 0, and proceeding to the processing of the linear spectrum takes place.

Next, a conversion coefficient is obtained for separating and extracting the correlation signal and the non-correlation signal from the left- and right-channel audio signals, using the normalization correlation coefficient $d^{(i)}$ (Step S6). The correlation signal and the non-correlation signal are separated and extracted from the left- and right-channel audio signals using the conversion coefficients obtained in Step S6, respectively (Step S7). Any one of the correlation signal and the non-correlation signal may be extracted as estimated audio signals.

An example of each processing of Steps S6 and S7 is described. Here, as in PTL 1, each of the left- and right-channel signals is configured from the non-correlation signal and the correlation signal, and for the correlation signal, a model is employed in which signal waveforms (to be more precise, signal waveforms each being made from the frequency components) that only have different gains are set to be output from the left and the right. Here, the gain is equivalent to the amplitude of the signal waveform, and is a value relating to sound pressure. Then, in the model, a direction of a sound image that results from synthesis of the correlation signals that are output from the left and the right is set to be determined by a sound pressure balance of each of the left and right correlation signals. According to the model, input signals $x_L(n)$ and $x_R(n)$ are expressed as follows.

$$x_L(m)=s(m)+n_L(m)$$

$$x_R(m)=\alpha s(m)+n_R(m) \tag{8}$$

In Equation (8), s(m) can be defined as the left and right correlation signals, and $n_L(m)$, which results from subtracting the correlation signal s(m) from a left channel audio signal, can be defined as a non-correlation signal (of a left channel). Then, $n_R(m)$, which results from subtracting from a right channel audio signal a result of multiplying the correlation signal s(m) by $\alpha$, can be defined as a non-correlation signal (of a right channel). Furthermore, $\alpha$ is a positive real number indicating the extent of the sound pressure balance of each of the left and right correlation signals.

According to Equation (8), the audio signal $x'_L(m)$ and $x'_R(m)$ after performing the window function multiplication described in Equation (2) are expressed in Equation (9) that follows. However, s'(m), $n'_L(m)$, and $n'_R(m)$ result from multiplying s(m), $n_L(m)$, and $n_R(m)$ by the window function, respectively.

$$x'_L(m)=w(m)\{s(m)+n_L(m)\}=s'(m)+n'_L(m)$$

$$x'_R(m)=w(m)\{\alpha s(m)+n_R(m)\}=\alpha s'(m)+n'_R(m) \tag{9}$$

When the discrete Fourier transform is applied to Equation (9), Equation (10) that follows is obtained. However, S(k), $N_L(k)$, and $N_R(k)$ result from performing the discrete Fourier transform on s'(m), $n'_L(m)$, and $n'_R(m)$, respectively.

$$X_L(k)=S(k)+N_L(k),$$

$$X_R(k)=\alpha S(k)+N_R(k) \tag{10}$$

Therefore, an audio signals $X_L^{(i)}(k)$ and $X_R^{(i)}(k)$ in an i-th linear spectrum are expressed as follows.

$$X_L^{(i)}(k)=S^{(i)}(k)+N_L^{(i)}(k)$$

$$X_R^{(i)}(k)=\alpha^{(i)}S^{(i)}(k)+N_R^{(i)}(k) \tag{11}$$

In Equation (11), $\alpha^{(i)}$ indicates a in the i-th linear spectrum. Thereafter, a correlation signal $S^{(i)}(k)$, a non-correlation signal $N_L^{(i)}(k)$, and $N_R^{(i)}(k)$ in the i-th linear spectrum are set to be expressed as follows.

$$S^{(i)}(k)=S(k)$$

$$N_L^{(i)}(k)=N_L(k)$$

$$N_R^{(i)}(k)=N_R(k) \tag{12}$$

From Equation (11), the sound pressure $P_L^{(i)}$ and $P_R^{(i)}$ in Equation (7) are derived as follows.

$$P_L^{(i)}=P_S^{(i)}+P_N^{(i)},$$

$$P_R^{(i)}=[\alpha^{(i)}]^2P_S^{(i)}+P_N(i) \tag{13}$$

In Equation (13), $P_S^{(i)}$ and $P_N^{(i)}$ are power of the correlation signal and power of the non-correlation signal in the i-th linear spectrum, respectively and are expressed as follows.

[Math. 5]

$$P_S^{(i)}=|S(k)|^2,\ P_N^{(i)}=|N_L(k)|^2=|N_R(k)|^2 \tag{14}$$

In Equation (14), the sound pressure of the left non-correlation signal and the sound pressure of the right non-correlation signal are assumed to be equal to each other.

Furthermore, from Equations (5) to (7), Equation (4) can be derived as follows.

[Math. 6]

$$d^{(i)}=\frac{\alpha^{(i)}P_S^{(i)}}{\sqrt{P_L^{(i)}P_R^{(i)}}} \tag{15}$$

However, in this calculation, power that exists when S(k), $N_L(k)$, and $N_R(k)$ are orthogonal to one another and are combined by multiplication is assumed to be 0.

The following equation is obtained by solving Equations (13) and (15).

[Math. 7]

$$\alpha^{(i)}=\frac{\beta}{2\gamma},\ P_S^{(i)}=\frac{2\gamma^2}{\beta},\ P_N^{(i)}=P_L^{(i)}-P_S^{(i)}=P_L^{(i)}-\frac{2\gamma^2}{\beta} \tag{16}$$

However, $\beta$ and $\gamma$ are intermediate variables. The following equation is obtained.

$$\beta=P_R^{(i)}-P_L^{(i)}+\sqrt{(P_L^{(i)}-P_R^{(i)})^2+4P_L^{(i)}P_R^{(i)}[d^{(i)}]^2},\ \gamma=d^{(i)}\sqrt{P_L^{(i)}P_R^{(i)}} \tag{17}$$

The correlation signal and the non-correlation signal in each linear spectrum are estimated using these values. An estimated value $est(S^{(i)}(k))$ of the correlation signal $S^{(i)}(k)$ in the i-th linear spectrum is expressed as follows, using parameters $\mu_1$ and $\mu_2$.

$$est(S^{(i)}(k))=\mu_1X_L^{(i)}(k)+\mu_2X_R^{(i)}(k) \tag{18}$$

From Equation (18) an estimated error $\epsilon$ is expressed as follows.

$$\epsilon=est(S^{(i)}(k))-S^{(i)}(k) \tag{19}$$

In Equation (19), est(A) is set to be an estimated value of A. Then, when a square error $\epsilon^2$ is minimized, if the characteristic that $\epsilon$ and $X_L^{(i)}(k)$, and $X_R^{(i)}(k)$ are orthogonal to each other is used, the following relationship is established.

$$E[\epsilon\cdot X_L^{(i)}(k)]=0,\ E[\epsilon\cdot X_R^{(i)}(k)]=0 \tag{20}$$

When using Equations (11), (14), and (16) to (19), the following simultaneous equation can be derived from Equation (20).

$$(1-\mu_1-\mu_2\alpha^{(i)})P_S(i)-\mu_1P_N^{(i)}=0$$

$$\alpha^{(i)}(1-\mu_1-\mu_2\alpha^{(i)})P_S(i)-\mu_2P_N^{(i)}=0 \tag{21}$$

Each parameter is obtained by solving Equation (21), as follows.

[Math. 8]

$$\mu_1 = \frac{P_S^{(i)}}{([\alpha^{(i)}]^2+1)P_S^{(i)}+P_S^{(i)}+P_X^{(i)}},\ \mu_2 = \frac{\alpha^{(i)}P_S^{(i)}}{([\alpha^{(i)}]^2+1)P_S^{(i)}+P_N^{(i)}} \tag{22}$$

At this point, power $P_{est(S)}^{(i)}$ of an estimated value $est(S^{(i)}(k))$ that is obtained in this manner needs to satisfy the following equation that is obtained by squaring both sides of Equation (18).

$$P_{est(S)}^{(i)}=(\mu_1+\alpha^{(i)}\mu_2)^2P_S^{(i)}+(\mu_1^2+\mu_2^2)P_N(i) \tag{23}$$

For this reason, an estimated value is scaled from Equation (23) as in the following equation. Moreover, $est'(A)$ indicates a result of scaling an estimated value of A.

[Math. 9]

$$est'(S^{(i)}(k)) = \frac{\sqrt{P_S^{(i)}}}{\sqrt{(\mu_1+\alpha^{(i)}\mu_2)^2P_S^{(i)}+(\mu_1^2+\mu_2^2)P_N^{(i)}}\ est(S^{(i)}(k))} \tag{24}$$

Then, estimated values $est(N_L^{(i)}(k))$ and $est(N_R^{(i)}(k))$ with respect to the left- and right-channel non-correlation signals $N_L^{(i)}(k)$ and $N_R^{(i)}(k)$ in the i-th linear spectrum are expressed, respectively, as follows.

$$est(N_L^{(i)}(k))=\mu_3X_L^{(i)}(k)+\mu_4X_R^{(i)}(k) \tag{25}$$

$$est(N_R^{(i)}(k))=\mu_5X_L^{(i)}(k)+\mu_6X_R^{(i)}(k) \tag{26}$$

From Equations (25) and (26), parameters $\mu_3$ to $\mu_6$ can be obtained in the same manner as is the case with the obtainment method described above, as follows.

[Math. 10]

$$\mu_3 = \frac{[\alpha^{(i)}]^2P_S^{(i)}+P_S^{(i)}}{([\alpha^{(i)}]^2+1)P_S^{(i)}+P_S^{(i)}},\ \mu_4 = \frac{-\alpha^{(i)}P_S^{(i)}}{([\alpha^{(i)}]^2+1)P_S^{(i)}+P_S^{(i)}} \tag{27}$$

$$\mu_5 = \frac{-\alpha^{(i)}P_S^{(i)}}{([\alpha^{(i)}]^2+1)P_S^{(i)}+P_N^{(i)}},\ \mu_6 = \frac{P_S^{(i)}+P_N^{(i)}}{([\alpha^{(i)}]^2+1)P_S^{(i)}+P_N^{(i)}} \tag{28}$$

Estimated values $est(N_L^{(i)}(k))$ and $est(N_R^{(i)}(k))$ that are obtained in this manner are also scaled by the following equation, as described.

[Math. 11]

$$est'(N_L^{(i)}(k)) = \frac{\sqrt{P_N^{(i)}}}{\sqrt{(\mu_3+\alpha^{(i)}\mu_4)^2P_S^{(i)}+(\mu_3^2+\mu_4^2)P_N^{(i)}}}est(N_L^{(i)}(k)) \tag{29}$$

$$est'(N_R^{(i)}(k)) = \frac{\sqrt{P_N^{(i)}}}{\sqrt{(\mu_s+\alpha^{(i)}\mu_6)^2P_S^{(i)}+(\mu_5^2+\mu_t^2)P_N^{(i)}}}est(N_R^{(i)}(k)) \tag{30}$$

The parameters $\mu_1$ to $\mu_6$ expressed in Equations (22), (27), and (28) and scaling coefficients expressed in Equations (24), (29), and (30) correspond to the conversion coefficients that are obtained in Step S6. Then, in Step S7, the correlation signals and the non-correlation signals (right-channel non-correlation signal and a left-channel non-correlation signal) are separated and extracted by performing estimation using operations (Equations (18), (25), and (26)) that use these conversion coefficients.

Next, processing for allocation to the virtual sound source is performed (Step S8). According to the present invention, a low frequency band is pulled out (extracted) as described below, and separate processing is performed on the resulting low frequency band, but at this point, first, the processing for the allocation to the virtual sound source regardless of the frequency band is described.

Figure 13:
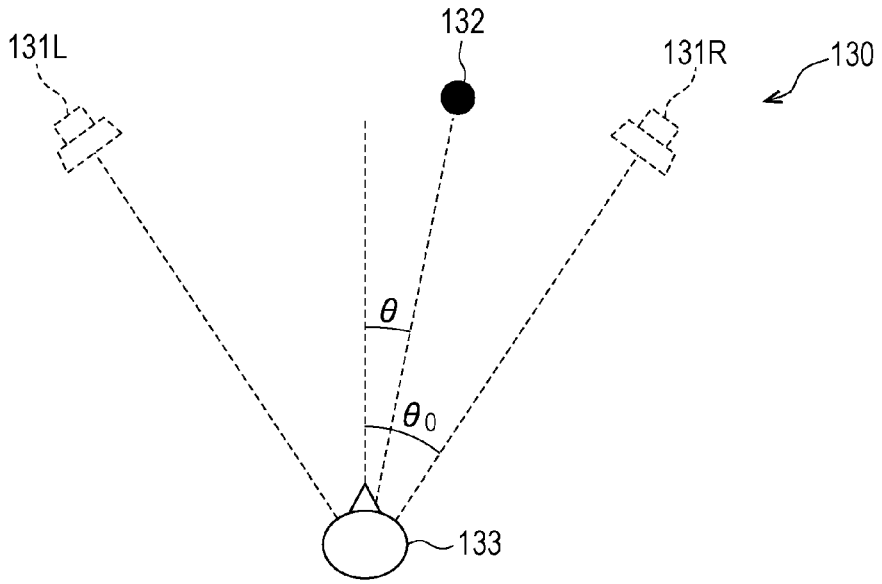
FIG. 13 is a schematic diagram for describing an example of a positional relationship between a listener, left and right speakers, and a synthetic sound image.
Figure 14:
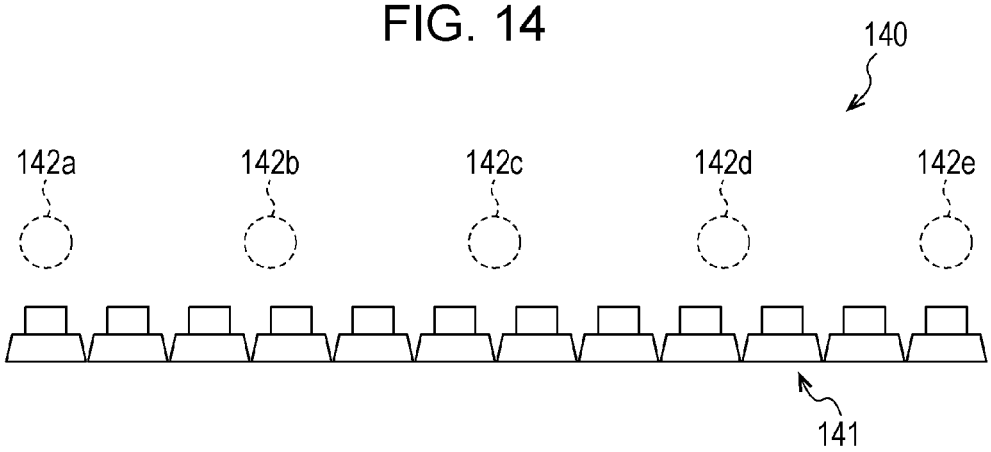
FIG. 14 is a schematic diagram for describing an example of a positional relationship between a speaker group that is used with the wavefront synthesis playback type and a virtual sound source.
Figure 15:
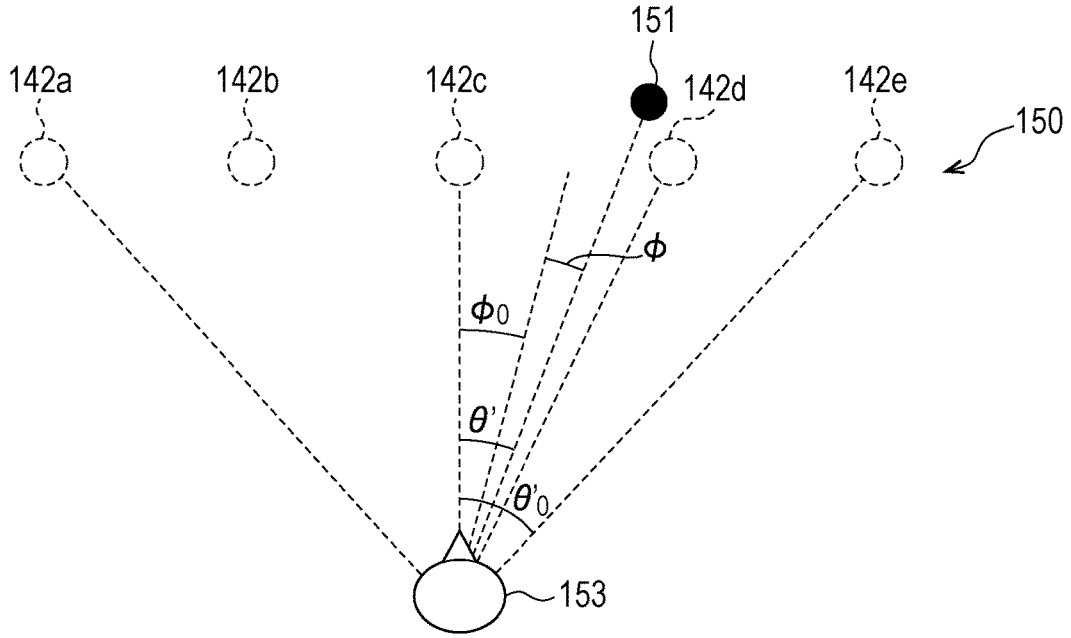
FIG. 15 is a schematic diagram for describing an example of a positional relationship between the virtual sound source in FIG. 14, and the listener and the synthetic sound image.

First, in the processing for the allocation, as preprocessing, direction of the synthetic sound image that is generated by the correlation signal estimated for every linear spectrum is estimated. The estimation processing is described referring to FIGS. 13 to 15. FIG. 13 is a schematic diagram for describing an example of a positional relationship between a listener, left and right speakers, and a synthetic sound image. FIG. 14 is a schematic diagram for describing an example of a positional relationship between a speaker group that is used with the wavefront synthesis playback type and a virtual sound source. FIG. 15 is a schematic diagram for describing an example of a positional relationship between the virtual sound source in FIG. 14, and the listener and the synthetic sound image.

Now, as in a positional relationship 130 that is illustrated in FIG. 13, an opening angle between a bisector of an angle between a line from the listener to a left speaker 131L and a line from the listener to a right speaker 131R, and the line from the listener 133 to any one of the left and right speakers 131L and 131R is set to $\theta_0$, and an opening angle between the bisector and a line from the listener 133 to an estimated synthetic sound image 132 is set to $\theta$. At this point, in a case where a sound pressure balance of the same audio signal from the left and right speakers 131L and 131R is changed and is output, generally, it is known that a direction of a synthetic sound image 132 that is generated by such an output audio can be approximated with the following equation that uses the parameter $\alpha$ indicating the sound pressure balance, which is described above (this is hereinafter referred to as a sine rule in stereophonic sound).

[Math. 12]

$$\theta = \sin^{-1}\left(\frac{\alpha-1}{\alpha+1}\sin\theta_0\right) \tag{31}$$

At this point, in order for a 2 channel stereo audio signal to be played back using the wavefront synthesis playback type, the audio signal separation and extraction unit 81 that is illustrated in FIG. 8 converts a two channel signal into multiple channel signals. For example, in a case where the number of channels after conversion is set to 5, these are regarded as virtual sound sources 142*a* to 142*e* as with the wavefront synthesis playback type, as in a positional relationship 140 that is illustrated in FIG. 14, and are arranged in rear of a speaker group (speaker array) 141. Moreover, distances between the virtual sound source and the virtual sound sources 142*a* to 142*e* are set to be equal to one another. Therefore, the conversion at this point is conversion of 2 channel audio signals into audio signals of which the number is the number of virtual sound sources. As described above, the audio signal separation and extraction unit 81 first separates the 2 channel audio signals into one correlation signal and two non-correlation signals for every linear spectrum. In the audio signal separation and extraction unit 81, additionally it has to be determined in advance how these signals are allocated to the virtual sound sources (here, 5 virtual sound sources) of which the number is predetermined. Moreover, one allocation method may be selected by user setting from among the multiple allocation methods, and the selectable methods according to the number of virtual sound sources may be changed and be provided to a user.

The following method is employed as one example of the allocation method. In the one example, first, the left and right non-correlation signals are allocated to both ends (virtual sound sources 142*a* and 142*e*) of five virtual sound sources, respectively. Next, a synthetic sound image that is generated by the correlation signal is allocated to two adjacent virtual sound sources among the five virtual sound sources. As a precondition for determining which two adjacent virtual sound sources the synthetic sound image is allocated to, first, the synthetic sound image that is generated by the correlation signal is set to be arranged more inward than the ends (virtual sound sources 142*a* and 142*e*) of the five virtual sound sources, that is, the five virtual sound sources 142*a* to 142*e* are set to be arranged inside of the opening angle between a line from the listener to one speaker and a line from the listener to the other speaker at the time of 2 channel stereo playback. Then, the allocation method is employed in which, from an estimated direction of the synthetic sound image, two virtual sound sources that are adjacent to each other in such a manner as to interpose the synthetic sound image are determined and the allocation of the sound pressure balance to the two virtual sound sources is adjusted, thereby performing the playback in such a manner as to generate the synthetic sound image by the two virtual sound sources.

Accordingly, as in a positional relationship 150 that is illustrated in FIG. 15, an opening angle between a bisector of an angle between a line from a listener 153 to the virtual sound source 142*a* at one end and a line from the listener 153 to the virtual sound source 142*e* at the other end, and a line from the listener 153 to the virtual sound source 142*e* at the other end is set to $\theta_0$, and an opening angle between the bisector and a line from the listener 153 to a synthetic sound image 151 is set to $\theta$. Additionally, an opening angle between a bisector of an angle between a line from the listener 153 to the virtual sound source 142*c* and a line from the listener 153 to the virtual sound source 142*d*, with the two virtual sound sources 142*c* and 142*d* interposing the synthetic sound image 151, and the bisector (a line from the listener 153 to the virtual sound source 142*c*) of the angle between the line from the listener 153 to the virtual sound source 142*a* at one end and the line from the listener 153 to the virtual sound source 142*e* at the other end is set to $\phi_0$, and an opening angle between the bisector of the angle between the line from the listener 153 to the virtual sound source 142*c* and the line from the listener 153 to the virtual sound source 142*d* and a line from the listener 153 to the synthetic sound image 151 is set to $\phi$. At this point, $\phi_0$ is a positive real number. A method is described in which the synthetic sound image 132 (which corresponds to the synthetic sound image 151 in FIG. 15) in FIG. 13, of which the direction is estimated as described in Equation (31), is allocated to the virtual sound source using these variables.

First, a direction $\theta^{(i)}$ of the i-th synthetic sound image is estimated by Equation (31), and for example, is set to $\theta^{(i)}=\pi/15$ [rad]. Then, in a case where five virtual sound sources are present, the synthetic sound image 151, as illustrated in FIG. 15, is positioned between the third virtual sound source 142*c* and the fourth virtual sound source 142*d* from the left. Furthermore, in the case where the five virtual sound sources are present, between the third virtual sound source 142*c* and the fourth virtual sound source 142*d*, $\phi_0 \cong 0.121$ [rad] is obtained by performing simple geometric calculation that uses a trigonometric function. When $\phi$ is set to $\phi^{(i)}$ in the i-th linear spectrum, $\phi^{(i)}=\theta^{(i)}-\phi_0 \cong 0.088$ [rad] is obtained. In this manner, the direction of the synthetic sound image that is generated by the correlation signal in each linear spectrum is indicated by a relative angle from the directions of two virtual sound sources interposing the synthetic sound image. Then, as described above, it is considered that the synthetic sound image is generated with the two virtual sound sources 142*c* and 142*d*. To do so, the sound pressure balances of the output audio signals from the two virtual sound sources 142*c* and 142*d* may be adjusted, and the sine rule in the stereophonic sound, which is used as Equation (31), is used as an adjustment method.

At this point, among the two virtual sound sources 142*c* and 142*d* interposing the synthetic sound image that is generated by the correlation signal in the i-th linear spectrum, when a scaling coefficient with respect to the third virtual sound source 142*c* is set to $g_1$ and a scaling coefficient with respect to the fourth virtual sound source 142*d* is set to $g_2$, an audio signal, $g_1 \cdot est'(S^{(i)}(k))$, is output from the third virtual sound source 142*c* and an audio signal, $g_2 \cdot est'(S^{(i)}(k))$, is output from the fourth virtual sound source 142*d*.

[Math. 13]

$$\frac{\sin\phi^{(i)}}{\sin\phi_0} = \frac{g_2 - g_1}{g_2 + g_1} \tag{32}$$

Then, $g_1$ and $g_2$ have to satisfy Equation (32) according to the sine rule in the stereophonic sound.

On the other hand, when $g_1$ and $g_2$ are normalized in such a manner that a sum of power from the third virtual sound source 142*c* and the fourth virtual sound source 142*d* is equal to power of an original 2 channel stereo correlation signal, the following equation is obtained.

$$g_1^2+g_2^2=1+[\alpha^{(i)}]^2 \tag{33}$$

The following equation is obtained by setting up simultaneous equations.

[Math. 14]

$$g_1 = \frac{1}{1+q^2} \cdot \sqrt{1+[\alpha^{(i)}]^2}\ ,\ g_2 = \frac{q}{\sqrt{1+q^2}} \cdot \sqrt{1+[\alpha^{(i)}]^2} \tag{34}$$

However, $$q = \frac{\sin\phi_0 + \sin\phi^{(i)}}{\sin\phi_0 - \sin\phi^{(i)}}$$

$g_1$ and $g_2$ are calculated by substituting $\phi^{(i)}$ and $\phi_0$, which are described above, into Equation (34). Based on the scaling coefficient that is calculated in this manner, as described above, an audio signal, $g_1 \cdot est'(S^{(i)}(k))$ is allocated to the third virtual sound source 142*c*, and an audio signal $g_2 \cdot est'(S^{(i)}(k))$ is allocated to the fourth virtual sound source 142*d*. Then, as described above, the non-correlation signal is allocated to the virtual sound sources 142*a* and 142*e* at both ends. That is, $est'(N_L^{(i)}(k))$ is allocated to the first virtual sound source 142*a*, and $est'(N_R^{(i)}(k))$ is allocated to the fifth virtual sound source 142*e*.

As opposed to this example, if the estimated direction of the synthetic sound image is provided between the first and second virtual sound sources, both $g_1 \cdot est'(S^{(i)}(k))$ and $est'(N_L^{(i)}(k))$ are allocated to the first virtual sound source. Furthermore, if the estimated direction of the synthetic sound image is provided between the fourth and fifth virtual sound sources, both $g_2 \cdot est'(S^{(i)}(k))$ and $est'(N_R^{(i)}(k))$ are allocated to the fifth virtual sound source.

As described above, the allocation of the left- and right-channel correlation signals and the left- and right-channel non-correlation signals is performed on the i-th linear spectrum in Step S8. The allocation is performed on all linear spectrums by loops in Steps S4*a* and S4*b*. For example, in a case where the 256-point discrete Fourier Transform is performed, the allocation is performed on the first to 127th linear spectrums. In a case where the 512-point discrete Fourier transform is performed, the allocation is performed on the first to 255th linear spectrums. In a case where the discrete Fourier transform is performed on an entire segment (1024 points), the allocation is performed on the first to 511st linear spectrums. As a result, when the number of virtual sound sources is set to J, output audio signals $Y_1(k)$ and so forth up to $Y_J(k)$ in the frequency domain with respect to the virtual sound sources (output channels) are obtained.

As described above, the audio signal playback device according to the present invention includes a conversion unit that performs the discrete Fourier transform on each of the 2 channel audio signals obtained from the multi-channel input audio signal, and a correlation signal extraction unit that, disregarding a direct current component, extracts the correlation signal from the 2 channel audio signals that result from the discrete Fourier transform by the conversion unit. The conversion unit and the correlation signal extraction unit are included in the audio signal separation and extraction unit 81 in FIG. 8.

Then, according to the present invention, at this point, processing for compensating for a reduction in the sound pressure in a low frequency band, which results from using speakers of which the number is small or using small-diameter speakers, is additionally performed as a main feature of the present invention. For this reason, first, the correlation signal extraction unit pulls (extracts) the correlation signal in a lower frequency than a predetermined frequency $f_{low}$ out of (from) an extracted correlation signal S(k). The pulled-out correlation signal is an audio signal in a low frequency band, and is hereinafter referred to as $Y_{LFE}(k)$. Such a method is described referring to FIGS. 16 and 17.

Figure 16:
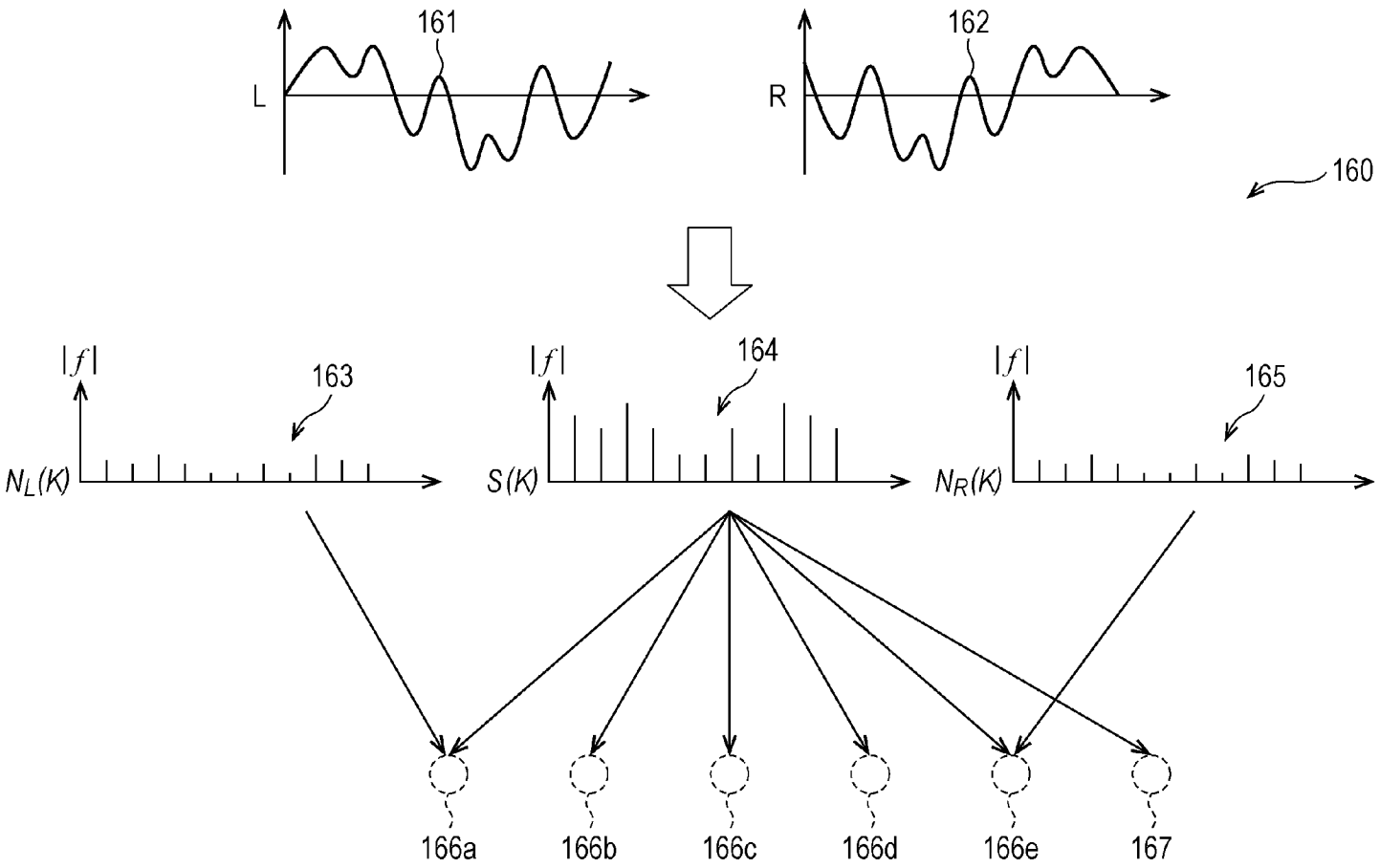
FIG. 16 is a schematic diagram for describing one example of the audio signal processing in the audio signal processing unit in FIG. 8.
Figure 17:
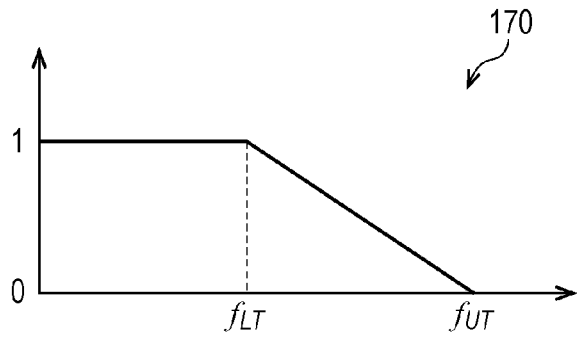
FIG. 17 is a diagram for describing one example of a low-pass filter for pulling out the low frequency band in the audio signal processing in FIG. 16.

FIG. 16 is a schematic diagram for describing one example of the audio signal processing in the audio signal processing unit in FIG. 8. FIG. 17 is a diagram for describing one example of a low-pass filter for pulling out the low frequency band in the audio signal processing in FIG. 16.

Two waveforms 161 and 162 indicate an input sound waveform in a left channel and an input sound waveform in a right channel, respectively, among two channels. A correlation signal S(k) 164 and a left non-correlation signal $N_L(k)$ 163, and a right non-correlation signal $N_R(k)$ 165 are extracted from these signals by the processing described above, and are allocated to five virtual sound sources 166*a* to 166*e* that are arranged in rear of the speaker group using the method described above. Moreover, codes 163, 164, and 165 indicate an amplitude spectrum (strength |f|) with respect to a frequency f of the linear spectrum.

According to the present invention, only the audio signal $Y_{LFE}(k)$ in a low frequency band is extracted by pulling out only the linear spectrum that is included in the low frequency band of the correlation signal S(k) before the allocation to the five virtual sound sources 166*a* to 166*e*. On this occasion, a low frequency range is defined, for example, by a low pass filter 170 as illustrated in FIG. 17. At this point, $f_{LT}$ is equivalent to a frequency in which a coefficient starts transition, and $f_{UT}$ is equivalent to the predetermined frequency $f_{low}$ that is a frequency in which the coefficient ends the transition. The predetermined frequency, for example, has to be stipulated as $f_{low}$=150 Hz and the like.

Furthermore, in the low pass filter 170, for frequencies from $f_{LT}$ to $f_{UT}$, a coefficient, multiplication by which is performed at the time of the pulling-out gradually decreases from 1. At this point, the coefficient decreases linearly, but is not limited to this. The coefficient may be made to transit in any way. Otherwise, only the linear spectrum that is equal to or less than $f_{LT}$ may be pulled out without a transition range (in this case, $f_{LT}$ is equivalent to the predetermined frequency $f_{low}$).

Then, the correlation signal after pulling the audio signal $Y_{LFE}(k)$ in the low frequency band out of the correlation signal S(k) 164, and the left non-correlation signal $N_L(k)$ 163 and the right non-correlation signal $N_R(k)$ 165 are allocated to the five virtual sound sources 166*a* to 166*e*. At the time of allocation, the left non-correlation signal $N_L(k)$ 163 is allocated to the leftmost virtual sound source 166*a*, the right non-correlation signal $N_R(k)$ 165 is allocated to the rightmost virtual sound source 166*e* (the rightmost virtual sound source except for the virtual sound source 167 described below).

Furthermore, the audio signal $Y_{LFE}(k)$ in a low frequency band, which is created by the pulling out of the correlation signal S(k) 164, for example, is allocated to one virtual sound source 167 that is separated from the five virtual sound sources 166*a* to 166*e*. The virtual sound sources 166*a* to 166*e* may be equally arranged in rear of the speaker group, and the virtual sound source 167 has to be arranged away from the same line. The audio signal $Y_{LFE}(k)$ in a low frequency band, which is allocated to the virtual sound source 167, and the remaining audio signals that are allocated to the virtual sound sources 166*a* to 166*e* are output from the speaker group (speaker array).

At this point, a method of playing back the virtual sound source (a method of synthesizing the wavefront) varies depending on the virtual sound source 167 to which the audio signal $Y_{LFE}(k)$ in a low frequency band is allocated, and the other virtual sound sources 166*a* to 166*e* to which the correlation signal in a different frequency band, and the left and right non-correlation signals are allocated. More specifically, for the other virtual sound sources 166*a* to 166*e*, a gain is increased as much as an output speaker that has an x coordinate that is positioned a short distance away from an x coordinate (a position in the horizontal direction) of the virtual sound source, and outputting is performed at earlier sound timing, but for the virtual sound source 167 that is created by the pulling-out, all gains are made equal and the outputting is performed with only output timing being the same as is described above. Accordingly, because, for the other virtual sound sources 166*a* to 166*e*, an output from a speaker that is positioned a great distance in terms of an x coordinate away from the virtual sound source is decreased, output performance of the speaker cannot be utilized. However, because, for the virtual sound source 167 for the pulling-out, loud sound is output from all the speakers, the total sound pressure is increased. Then, also in such a case, because the timing is controlled and the wavefronts are synthesized, the sound image is somewhat dim. However, the sound pressure can be increased with the sound image being localized. By this processing, the sound in a low frequency band can be prevented from falling short of the sound pressure.

In this manner, the audio signal $Y_{LFE}(k)$ in a low frequency band is output from the speaker group, but is output in such a manner as to form a synthetic wavefront. Preferably, the synthetic wavefront is formed by the allocation of the virtual sound source. To be more precise, preferably, the audio signal playback device according to the present invention includes an output unit as follows. The output unit allocates the correlation signal that is pulled out in the correlation signal extraction unit described above, to one virtual sound source and outputs a result of the allocation from one portion or all portions of the speaker group using the wavefront synthesis playback type. Moreover, the outputting from one portion or all portions of the speaker group is performed because, according to the sound image that is indicated by the correlation signal pulled out in the correlation signal extraction unit described above, there are a case where all portions of the speaker group are used and a case where only one portion of the speaker group is used.

At this point, the output unit corresponds to the sound output signal generation units 82 in FIGS. 7 and 8, and the D/A converter 74 and the amplifier 75 (and the speaker group 76) in FIG. 7. However, as described above, the audio signal separation and extraction unit 81 may be responsible for one portion of the wavefront synthesis playback processing.

The output unit described above plays back the pulled-put signal in a low frequency band, as one virtual sound source, from the speaker group, but there is a need for the adjacent speakers that are output destinations to satisfy a condition for generating and obtaining the synthetic wavefront in order to actually output the signal, in the form of such a synthetic wave, from the speaker group. The condition is a condition that, according to a space sampling frequency theorem, a time difference in a sound output between the adjacent speakers that have to perform the outputting falls within a range of $2\Delta x/c$.

At this point, $\Delta x$ is a distance (a distance between the centers of the speakers that have to perform the outputting) between the adjacent speakers that have to perform the outputting, and c is a sound speed. For example, when c=340 m/s and $\Delta x$ is 0.17 m, a value of the time difference is 1 ms. Then, a reciprocal of this value is an upper-limit frequency (which is defined as $f_{th}$) at which the wavefront synthesis is performed at this distance between the speakers, and in this example, $f_{th}$=1000 Hz. That is, in a case where the wavefronts are going to be synthesized with the time difference of within $2\Delta x/c$ from the adjacent speakers, the wavefronts of the sound of which a frequency is higher than the upper-limit frequency $f_{th}$ cannot be synthesized. In other words, the upper-limit frequency $f_{th}$ is determined by a distance between the speakers, and the reciprocal of the upper-limit frequency $f_{th}$ is an upper-limit value of limit time. When consideration is given in these respects, the predetermined frequency $f_{low}$ described above, as illustrated as 150 Hz, is stipulated as a frequency that is lower than the upper-limit frequency $f_{th}$ (for example, 1000 Hz), and the extraction of the correlation signal is performed. Furthermore, if the time difference described above falls within the range of $2\Delta x/c$, for any frequency that is lower than the predetermined frequency $f_{low}$, the wavefronts can be synthesized.

In other words, it can be said that the output unit according to the present invention outputs the pulled-out correlation signal from one portion or all portions of the speaker group in such a manner that the time difference in the sound output between the adjacent speakers that are output destinations falls within the $2\Delta x/c$. Actually, the conversion is performed on the pulled-out correlation signal in such a manner that the time difference in the sound output between the adjacent speakers that are the output destinations falls within the $2\Delta x/c$, and the pulled-out correlation signal is output from one portion or all portions of the speaker group, thereby forming the synthetic wavefront. Moreover, the adjacent speakers that are the output destinations are not limited to a case where the adjacent speakers are indicated in the installed speaker group and there is a case where only the speakers that are not adjacent to each other are the output destinations in the speaker group. In such a case, it has to be determined whether or not the speakers are adjacent to each other, taking into consideration only the output destination.

Furthermore, because the audio signal in a low frequency band has weak directivity and is a signal that is easy to diffract, although the audio signal is output from the speaker group in such a manner that, as described above, the audio signal is output from the virtual sound source 167, the audio signal spreads in all directions. Then, as in the example described referring to FIG. 16, the virtual sound source 167 does not need to be arranged on the same line as the virtual sound sources 166*a* to 166*e*, and may be arranged at any position.

Figure 18:
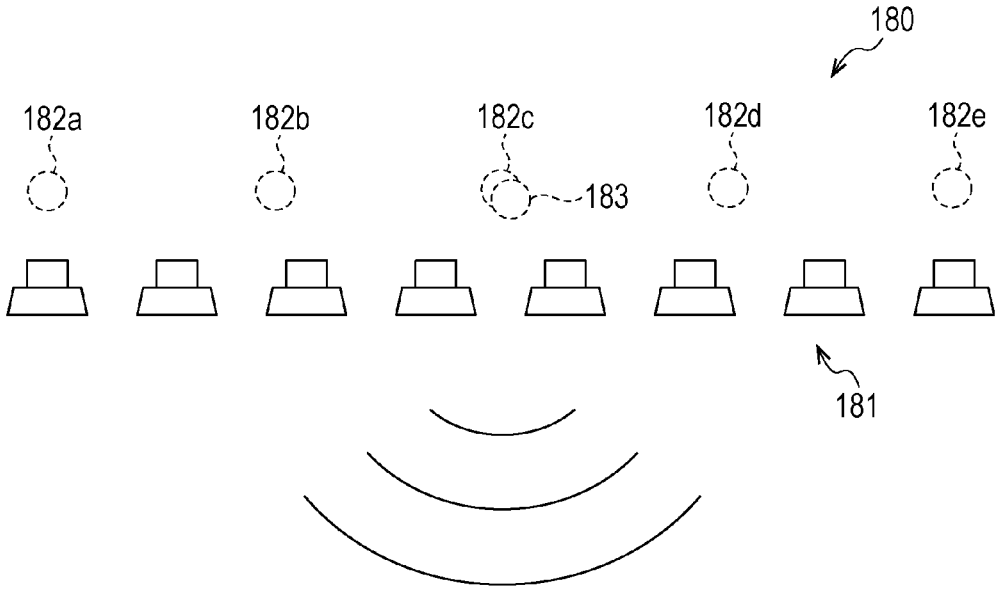
FIG. 18 is a diagram for describing an example of another position of a virtual sound source for a low frequency band, which is allocated in the audio signal processing in FIG. 16.

Furthermore, a position of the virtual sound source that is allocated as described above may not be necessarily separated from positions of the five virtual sound sources 166*a* to 166*e*. An example of another position of the virtual sound source for a low frequency band, which is allocated in the audio signal processing in FIG. 16, is described referring to FIG. 18. With regard to the position of the virtual sound source that is allocated, for example, as in the positional relationship 180 that is illustrated in FIG. 18, a virtual sound source 183 for a low frequency band may be set to be at a position that is the same as a position of a virtual sound source 182*c* that is arranged right in the middle of five virtual sound sources 182*a* to 182*e* (which correspond to the five virtual sound sources 166*a* to 166*e*, respectively). The audio signal $Y_{LFE}(k)$ in a low frequency band, which is allocated to the virtual sound source 183, or the remaining audio signals that are allocated to the virtual sound sources 182*a* to 182*e* are output from a speaker group (a speaker array) 181.

As described above, according to the prevent invention, not only the sound image can be faithfully recreated from any listening position by the playback using the wavefront synthesis playback type, but processing that varies according to the frequency band is also performed on the correlation signal, as described above. Thus, according to characteristics of a speaker array (a speaker unit), only a target low frequency band can be extracted with significantly high precision and the sound in a lower frequency band can be prevented from falling short of sound pressure. Furthermore, at this point, the characteristics of the speaker unit indicate characteristics of each speaker, and, if only the speaker array in which the same speakers are arranged side by side is present, are output frequency characteristics that are common to the speakers. Furthermore, if a woofer is present in addition to the speaker array, the characteristics of the speaker unit indicates characteristics that include output frequency characteristics of the woofer as well. These effects are useful particularly in a case where the audio signal is played back by the low cost-restricted speaker group using the wavefront synthesis playback type, such as when each channel is equipped with only a small-capacity amplifier in speakers of which the number is small or in small-diameter speakers.

Furthermore, in this manner, a low frequency component of each of the virtual sound sources (the virtual sound sources 166*a* to 166*e* in FIG. 16 and the virtual sound sources 182*a* to 182*e* in FIG. 18) is not only pressure-increased, but is also allocated to one virtual sound source (the virtual sound source 167 in FIG. 16 and the virtual sound source 183 in FIG. 18). Thus, interference due to the output of the low frequency component from the multiple virtual sound sources can be prevented.

Next, processing that is performed on each output channel that is obtained in Steps S1 to S8 in FIG. 9 is described. Processing in each of Steps S10 to S12 as described below is performed on each output channel (Steps S9*a* and S9*b*). Processing in each of Steps S10 to S12 will be described below.

First, an output audio signal $y'_j(m)$ in a time domain is obtained by performing inverse discrete Fourier transform on each output channel (Step S10). At this point, $DFT^{-1}$ indicates the inverse discrete Fourier transform.

$$Y'_j(m)=DFT^{-1}(Y_j(k))\ (1\leq j\leq J) \tag{35}$$

In Equation (35), as described in Equation (3), because the signal on which the discrete Fourier transform is performed is a signal after performing the window function multiplication, a signal $y'_j(m)$ that is obtained by reverse transform is also in a state where the multiplication by the window function is performed. Because the window function is a function as is expressed in Equation (1), the reading is performed while the shift by one-fourth of the length of a segment is performed, as described above, the post-conversion data is obtained by performing the addition to an output buffer while the shift by one-fourth of the length of the segment is performed starting from the head of the segment that is processed one segment earlier.

At this point, as described above, an operation using the Hann window is performed before performing the discrete Fourier transform. Because values of both end points of the Hann window are 0, if the inverse discrete Fourier transform is again performed without changing a value of any spectrum component after the discrete Fourier transform is performed, both end points of the segment are 0 and a non-contiguous point between the segments does not occur. However, actually, in a frequency domain that results from the discrete Fourier transform is performed, because each spectrum component is changed as described above, both end points of the segment that results from performing the inverse discrete Fourier transform is not 0 and the non-contiguous point between the segments occurs.

Therefore, because both end points are 0, as described above, the operation is again performed using the Hann window. Accordingly, it is guaranteed that both end points are 0 and, to be more precise, that the non-contiguous point does not occur. More specifically, among the audio signals (to be more precise, the correlation signals or the audio signals that are generated from the correlation signals) after the inverse discrete Fourier Transform is performed, the audio signal of the processing segment is multiplied two times by the Hann window function, only one-fourth of the length of the processing segment is shifted, and an addition to the audio signal of the previous processing segment is performed. Thus, the non-contiguous point in the waveform is removed from the audio signal after the discrete Fourier transform. At this point, the previous processing segment is an earlier processing segment, and, because actually a segment is shifted by one-fourth of the length of the segment, indicates a processing segment that exists one segment earlier, a processing segment that exists two segments earlier, and a processing segment that exists three segments earlier. Thereafter, as described above, if the processing segment that results from performing the Hann window function multiplication process two times is multiplied ⅔, which is a reciprocal of 3/2, the original waveform can be completely restored. Of course, after addition-target processing segment is multiplied by ⅔, the shift and the addition may be performed. Furthermore, although the processing that performs the multiplication by ⅔ is not performed, this is permissible as soon as the amplitude is increased.

Moreover, for example, in a case where the reading is performed while the shift by half the length of a segment is performed, if post-conversion data is obtained by performing the addition to an output buffer while the shift by half the length of the segment is performed starting from the head of the segment that is processed one segment earlier, this is permissible. In such a case, it is not guaranteed that the both end points are set to 0 (that the non-contiguous point does not occur), but any non-contiguous point removal processing has to be performed. When it comes to details of the non-contiguous point removal processing, for example, the non-contiguous point removal processing disclosed in PTL 1 has to be employed without performing the second window function operation. However, this has no direct relation with the present invention. Thus, a description of this is omitted.

Figure 19:
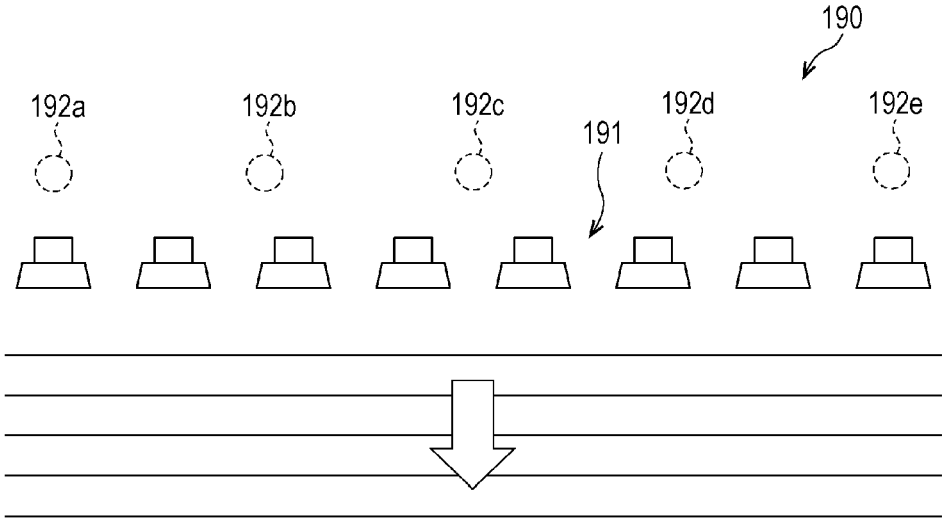
FIG. 19 is a schematic diagram for describing another example of the audio signal processing in the audio signal processing unit in FIG. 8.

Next, another example of the audio signal processing in the audio signal processing unit in FIG. 8 is described referring to a schematic diagram in FIG. 19.

As described above, the audio signal $Y_{LFE}(k)$ in a low frequency band is allocated to one virtual sound source and is played back using the wavefront synthesis playback type, but as in a positional relationship 190 that is illustrated in FIG. 19, the audio signal $Y_{LFE}(k)$ in a low frequency band may be played back using the wavefront synthesis playback type in such a manner that the synthetic wave from the speaker group 191 becomes a plane wave. In this manner, the output unit described above may output the correlation signal, which is pulled out in the correlation signal extraction unit described above, as the plane wave, from one portion or all portions of the speaker group using the wavefront synthesis playback type. At this point, in FIG. 19, an example is illustrated in which the plane wave that propagates in a direction perpendicular to an alignment direction (an array direction) of a speaker group 191 is output, but the plane wave can be output in such a manner as to propagate at a predetermined slope angle with respect to the alignment direction of the speaker group 191.

At this point, for the output in the form of the plane wave, (a) the plane wave has to be output from each speaker at the output timing that makes a delay between the adjacent speakers uniform occur at a regular interval. Moreover, as in the example in FIG. 19, in a case where the plane wave propagates in the direction perpendicular to the array direction, the plane wave has to be output from each speaker at the output timing that the predetermined interval is set to "0" and sets the delay between the adjacent speakers to "0". Furthermore, as another method, for the output in the form of the plane wave that propagates perpendicularly to the array direction as in the example in FIG. 19, (b) processing may be performed in such a manner that the plane wave is uniformly output from all the virtual sound sources (the virtual sound sources 166*a* to 166*e* and 167 in FIG. 16) that include at least one virtual sound source (the virtual sound source 167 in FIG. 16) to which the audio signal in a non-low frequency band is not allocated. As an application of (b) described above, the plane wave can be output in such a manner that the plane wave propagates at a predetermined slope angle with respect to the alignment direction of the speaker group by setting the alignment direction of the virtual sound source to be not only in parallel with the alignment direction of the speaker group, but also at an angle with respect to the alignment direction of the speaker group.

Also in a case where the output in the form of the plane wave is performed in this manner, it can be said that, because the synthetic wave is output, the output unit described above outputs the pulled-out correlation signal from one portion or all portions of the speaker group in such a manner that the time difference in the sound output between the adjacent speakers that are the output destinations falls within the range of $2\Delta x/c$. For example, also in any of the cases (a) and (b) described above, it is determined whether or not the wavefronts can be synthesized, depending on whether or not the time difference falls within the range of $2\Delta x/c$. Furthermore, a difference between the plane wave and a curved-surface wave is determined by how the three or more speakers that are arranged side by side puts delays in a sequence. Specifically, if the delays are put at an equal distance, the plane wave as illustrated in FIG. 19 is possible, and for example, if the distance becomes gradually greater as we go from the center to both ends, a curved surface (a convex surface) that is the same as a curved surface illustrated in FIG. 18 occurs. In this manner, if only two speakers are present, it is not determined whether the output becomes in the form of the plane wave or becomes in the form of the curved surface wave, but it is determined whether or not the wavefronts can be synthesized, depending on whether or not at least the time difference falls within the distance of $2\Delta x/c$.

Because the audio signal in the low frequency band has weak directivity and is a signal that is easy to diffract, although the audio signal is output in the form of the plane wave in this manner (is played back in the form of the plane wave), the audio signal spreads in all directions. However, because the audio signal in a middle frequency band or in a high frequency band has strong directivity, if the audio signal is output in the form of the plane wave, energy, like a beam, concentrates in a propagation direction of the audio signal and the sound pressure weakens in directions other than the propagation direction. Therefore, also in a configuration in which the audio signal $Y_{LFE}(k)$ (k) in a low frequency band is played back in the form of the plane wave, the correlation signal after pulling out the audio signal $Y_{LFE}(k)$ in a low frequency band and the left and right non-correlation signals are not played back in the form of the plane wave, are allocated to the virtual sound sources 192*a* to 192*e* in the same manner as in the example that is described referring to FIG. 16, and are output from the speaker group 191 using the wavefront synthesis playback type.

In this manner, in the example in FIG. 19, the audio signal $Y_{LFE}(k)$ (k) in a low frequency band is output in the form of the plane wave without being allocated to the virtual sound source, and the correlation signal in a different frequency band and the left and right non-correlation signal are allocated to the virtual sound source and are output. The playback method (the method of synthesizing the wavefronts) varies with these two outputting ways. Accordingly, for the virtual sound source to which the audio signal is allocated, in the same manner as described referring to FIG. 16, an output from a speaker that is positioned a great distance in terms of an x coordinate away from the virtual sound source is decreased. However, because, for the pulled-out audio signal $Y_{LFE}(k)$ (k) in a low frequency band, loud sound is output from all the speakers in order to form the plane wave, the total sound pressure is increased, and sound in a low frequency band can be prevented from falling short of the sound pressure.

Therefore, also in the example that is described referring to FIG. 19, not only the sound image can be faithfully recreated from any listening position by the playback using the wavefront synthesis playback type, but processing that varies according to the frequency band is also performed on the correlation signal, as described above. Thus, according to characteristics of a speaker array (a speaker unit), only a target low frequency band can be extracted with significantly high precision and the sound in a lower frequency band can be prevented from falling short of sound pressure.

Figure 20:
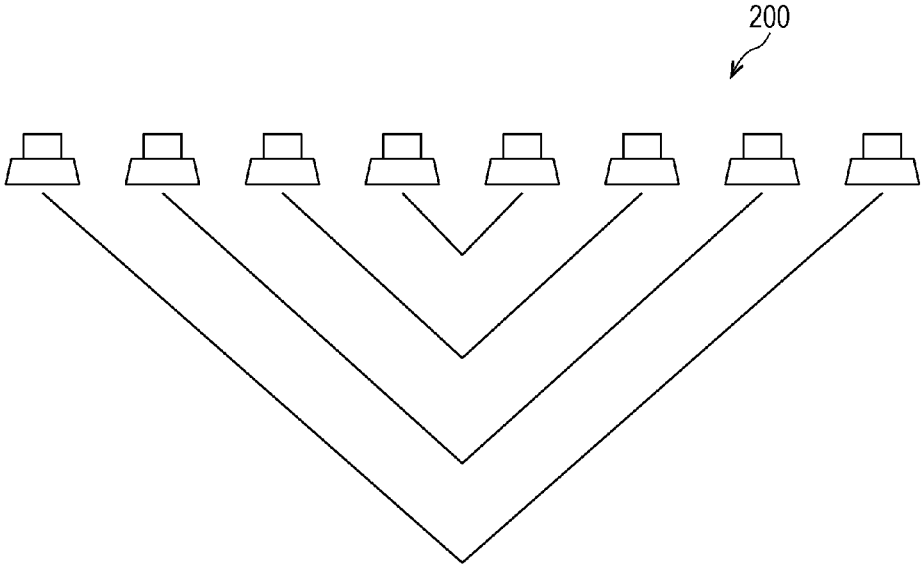
FIG. 20 is a schematic diagram for describing another example of the audio signal processing in the audio signal processing unit in FIG. 8.

Next, another example of the audio signal processing in the audio signal processing unit in FIG. 8 is described referring to a schematic diagram in FIG. 20.

As the plane wave, for example, as illustrated in FIG. 20, the plane wave may be created in two directions toward both ends from a direction in which the group 20 of speakers that are arranged side by side, with the delays being caused to occur uniformly.

Furthermore, the pulled-out correlation signal is not limited to an example in which one virtual sound source is output or to an example in which the outputting in the form of the plane wave is performed, and the following output method can be employed. For example, if only a significantly low frequency band is pulled out, when an extreme example is taken, although the delays are caused to occur randomly within the time difference described above, it is possible to emphasize a low tone without generating uncomfortable feeling in terms of auditory sensation. Therefore, if dependence on a frequency band that is pulled out is present, but the pulling-out of the frequency including up to a high-ratio frequency is performed, the normal wavefront synthesis (the curved-surface wave) as illustrated in FIG. 18 is desirable, the plane wave as illustrated in FIG. 19 is desirable, and it is desirable that the plane wave as illustrated in FIG. 20 is generated. However, if the pulling-out of the frequency including only a significantly low frequency band is performed, as long as the delays are caused to occur within the time difference described above, whichever delay may be caused to occur. A standard for such a boundary is in the neighborhood of 120 Hz at which sound is difficult to localize. To be more precise, if the predetermined frequency $f_{low}$ described above is set to be lower than the neighborhood of 120 Hz and the pulling-out is performed, the pulled-out correlation signal is randomly delayed within the time difference of $2\Delta x/c$ and thus can be output from one portion or all portions of the speaker group.

Figure 21:
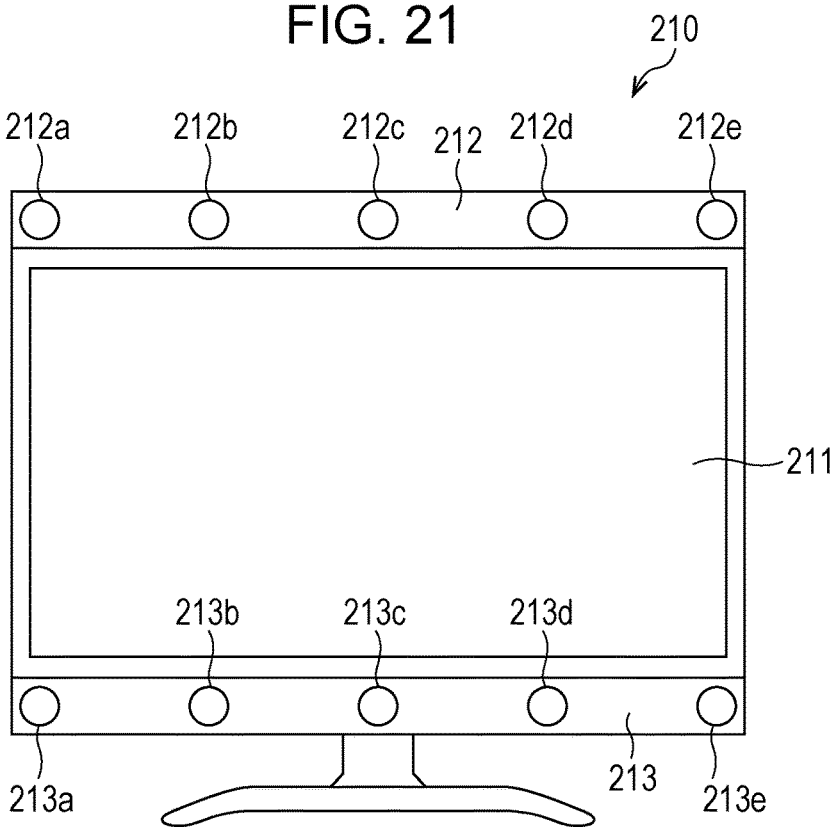
FIG. 21 is a diagram illustrating one configuration example of a television apparatus equipped with the audio signal playback device in FIG. 7.
Figure 22:
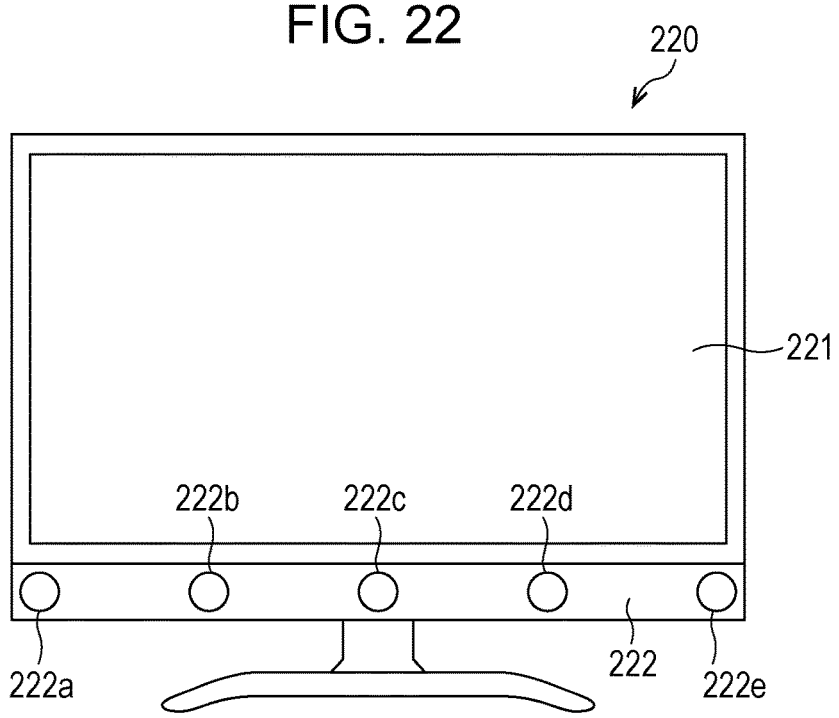
FIG. 22 is a diagram illustrating another configuration example of the television apparatus equipped with the audio signal playback device in FIG. 7.
Figure 23:
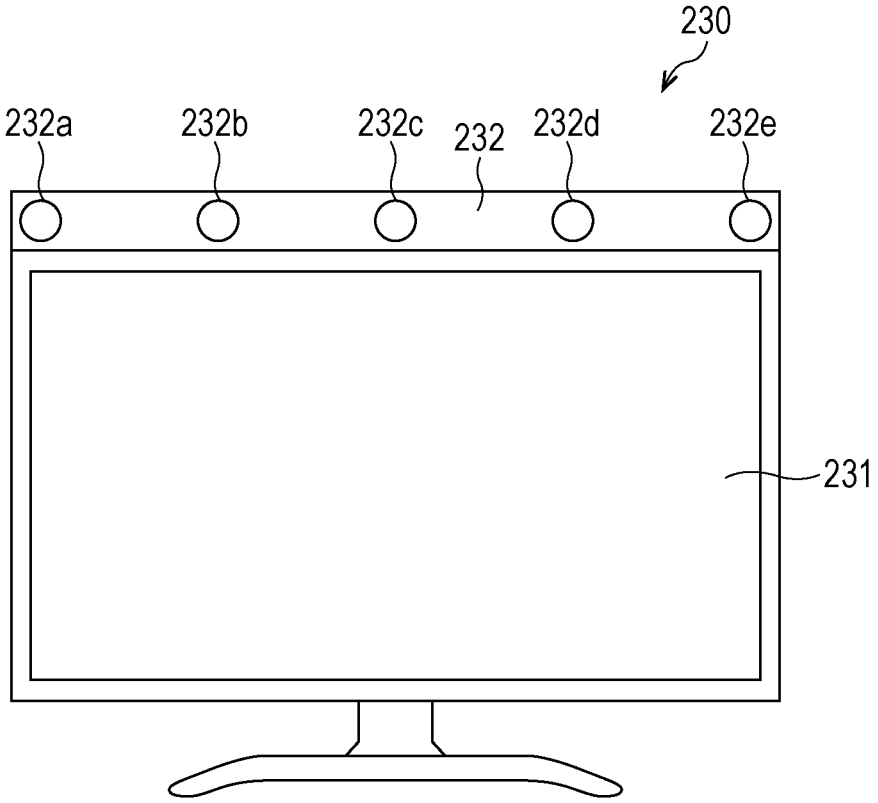
FIG. 23 is a diagram illustrating another configuration example of the television apparatus equipped with the audio signal playback device in FIG. 7.

Next, implementation according to the present invention is briefly described. The present invention can be used in an apparatus that is accompanied by an image, such as a television apparatus. Various examples of apparatuses to which the present invention is applicable are described referring to FIGS. 21 to 23. FIGS. 21 to 23 are diagrams each of which illustrates a configuration example of the television apparatus that includes the audio signal playback device in FIG. 7. Moreover, in each of FIGS. 21 to 23, an example is taken in which five speakers are arranged in one row as the speaker array, but the number of speaker has to be two or more.

The audio signal playback device according to the present invention can be used in the television apparatus. Arrangement of these devices in the television apparatus has to be freely determined. As in a television apparatus 210 that is illustrated in FIG. 21, in the audio signal playback device, a speaker group 212 in which speakers 212*a* to 212*e* are linearly arranged side by side and a speaker group 213 in which speakers 213*a* to 213*e* are linearly arranged side by side may be provided above and below a television screen 211, respectively. As in a television apparatus 220 that is illustrated in FIG. 22, in the audio signal playback device, a speaker group 222 in which speakers 222*a* to 222*e* are linearly arranged side by side may be provided below a television screen 221. As in a television apparatus 230 that is illustrated in FIG. 23, in the audio signal playback device, a speaker group 232 in which speakers 232*a* to 232*e* are linearly arranged side by side may be provided above a television screen 231. Furthermore, although not illustrated, if some cost is met, in the audio signal playback device, a speaker group in which transparent film-type speakers are linearly arranged side by side may be buried into the television screen.

In this manner, by installing the speaker array below and above the screen, or above or below the screen, although the number of speakers is small or the speaker array is small in diameter, the television apparatus can be realized in which the audio signal playback in which, although the frequency band is a low frequency band, the sound pressure is great, is possible using the wavefront synthesis playback type.

In addition, the audio signal playback device according to the present invention can be buried into a television stand (a television board), or can be buried into an integrated-type speaker system called a sound bar, which is placed under the television apparatus. In any case, only a portion that converts the audio signal can be provided at the side of the television apparatus. In addition, the audio signal playback device according to the present invention can be applied to a car audio in which speakers in a group are circularly arranged.

Furthermore, when the audio signal playback processing according to the present invention is applied to an apparatus such as the television apparatus as described referring to FIGS. 21 to 23, a switching unit can be provided that enables the listener to perform switching by a user operation such as an operation of buttons provided in a main body of the apparatus or a remote control operation in order to determine whether or not to perform the processing (the processing by the audio signal processing unit 73 in FIG. 7 or 8). In a case where the conversion processing is not performed, the same processing is applied regardless of whether the frequency band is a low frequency band, the virtual sound source is arranged, and the playback and the like have to be performed using the wavefront synthesis playback type.

Furthermore, as the wavefront synthesis playback type that is applicable according to the present invention, there are provided various types including a prior sound effect (an Haas effect) as a phenomenon relating to human being's sound image perception in addition to a WFS type disclosed in NPL 1, as well as a type in which, as described above, the speaker array (the multiple speakers) are provided, and the outputting as a sound image with respect to the virtual sound from the speakers is performed. At this point, the prior sound effect indicates an effect in which, in a case where the same sound is played back from the multiple sound sources and there is a small time difference to each piece of sound that reaches a hearer from each of the sound sources, a sound image is localized in a sound source direction of the sound that reaches the listener earlier. If this effect is used, it is possible to perceive the sound image at a virtual sound source position. However, the sound image is difficult to perceive clearly only with the effect. At this point, a human being has the capacity to perceive the sound image in a direction in which the sound pressure is felt in a greatest manner. Therefore, in the audio signal playback device, it is possible that the prior sound effect described above and the maximum sound pressure direction perception effect are combined together and thus, although the number of speakers is small, the sound image is perceived in a direction of the virtual sound source.

The example is described above in which the audio signal playback device according to the present invention generates and plays back the wavefront synthesis playback type of audio signal by converting the multi-channel playback type of audio signal. However, the audio signal playback device according to the present invention is not limited to the multi-channel playback type of audio signal, and can be configured such that the wavefront synthesis playback type of audio signal is set to be the input audio signal, and the input audio signal is converted into the wavefront synthesis playback type of audio signal and is played back, for example, in such a manner that the low frequency band is pulled out and separate processing is performed as described above.

Furthermore, each constituent element of the audio signal playback device according to the present invention, for example, such as the audio signal processing unit 73 illustrated in FIG. 7, can be realized in hardware, for example, such as a microprocessor (or a digital signal processor (DSP)), a memory, a bus, an interface, and a peripheral device, and in software that is capable of being run on these hardware devices. Some or all of the hardware devices can be mounted as an integrated circuit/IC chip set, and in such a case, the software has to be stored in the memory. Furthermore, all constituents of the present invention may be configured in hardware, and in such a case, it is possible to mount one portion or all portions of the hardware as an integrated circuit/IC chip set in the same manner.

Furthermore, an object of the present invention is accomplished although a recording medium on which software program codes for realizing functions in various configuration examples described above are recorded is supplied to an apparatus such as a general-purpose computer that is the audio signal playback device, and the program codes are implemented by the microprocessor or the DSP within the apparatus. In this case, although software program codes themselves realize the functions of various configuration examples described above and the program codes themselves or a recording medium (an external recording medium or an internal storage device) on which the program codes are recorded is provided, the present invention can be configured by causing the codes to be read and implemented at the control side. As the external recording media, an optical disk such as a CD-ROM or a DVD-ROM, a non-volatile semiconductor memory such as a memory card, and the like are variously available. As the internal storage devices, a hard disk, a semiconductor memory, and the like are variously available. Furthermore, the program codes can be downloaded over the Internet and be implemented or can be received from a broadcasting station and be implemented.

The audio signal playback device according to the present invention is described above, but as illustrated by a processing flow in a flow diagram, the present invention can also take the form of an audio signal playback method in which the multi-channel input audio signal is played back using the wavefront synthesis playback type by the speaker group.

The audio signal playback method includes a conversion step, an extraction step, and an output step as follows. The conversion step is a step in which the conversion unit performs the discrete Fourier transform on each of the 2 channel audio signals obtained from the multi-channel input audio signal. The extraction step is a step in which the correlation signal extraction unit pulls the correlation signal out of the 2 channel audio signals that result from the discrete Fourier transform in the conversion step, disregarding a direct current component, and additionally extracts the correlation signal in a lower frequency than a predetermined frequency $f_{low}$ from the correlation signal. The output step is a step in which the output unit outputs the correlation signal pulled out in the correlation signal extraction step from one portion or all portions of the speaker group in such a manner that the time difference in the sound output between adjacent speakers that are the output destinations falls within the range of $2\Delta x/c$ (here, $\Delta x$ is set to be a distance between the adjacent speakers, and c is a sound speed). Other application examples are as is the case with the description of the audio signal playback device and therefore descriptions of them are omitted.

Moreover, in other words, the program codes themselves is a program for causing a computer to perform the audio signal playback method, that is, the audio signal playback processing that plays back the multi-channel input audio signal using the wavefront synthesis playback type by the speaker group. That is, such a program is a program for causing the computer to performs a conversion step of performing discrete Fourier transform on each of 2 channel audio signals obtained from the multi-channel input audio signal; an extraction step of extracting a correlation signal from the 2 channel audio signals that result from the discrete Fourier transform in the conversion step, disregarding a direct current component, and additionally pulling a correlation signal in a lower frequency than a predetermined frequency $f_{low}$ out of the correlation signal, and an output step of outputting the correlation signal pulled out in the extraction step from one portion or all portions of the speaker group in such a manner that a time difference in a sound output between adjacent speakers that are output destinations falls within a range of $2\Delta x/c$. Other application examples are as is the case with the description of the audio signal playback device and therefore descriptions of them are omitted.

REFERENCE SIGNS LIST

70 AUDIO SIGNAL PLAYBACK DEVICE
71*a* DECODER
71*b* A/D CONVERTER
72 AUDIO SIGNAL EXTRACTION UNIT
73 AUDIO SIGNAL PROCESSING UNIT
74 D/A CONVERTER
75 AMPLIFIER
76 SPEAKER
81 AUDIO SIGNAL SEPARATION AND EXTRACTION UNIT
82 SOUND OUTPUT SIGNAL GENERATION UNIT

The invention claimed is:

1. An audio signal playback device that plays back a multi-channel input audio signal with a speaker group of a speaker array including at least two speakers, using a wavefront synthesis playback, the device comprising:

signal processing circuitry that performs signal processing on each of 2 or more channel audio signals obtained from the multi-channel input audio signal; and low frequency signal extraction circuitry that extracts a low frequency signal of a correlation signal with a lower frequency than a predetermined frequency from the 2 or more channel audio signals, wherein the signal processing circuitry outputs the low frequency signal of the correlation signal from the at least two speakers of the speaker array, and outputs the low frequency signal of the correlation signal such that a time difference in sound output between adjacent speakers of the at least two speakers is equal to or less than $2\Delta x/c$, where $\Delta x$ is a distance between the adjacent speakers, and c is the speed of sound.

2. The audio signal playback device according to claim 1, wherein the signal processing circuitry allocates the low frequency signal extracted in the low frequency signal extraction circuitry to one virtual sound source and outputs a result of the allocation from the at least two speakers using the wavefront synthesis playback.

3. The audio signal playback device according to claim 1, wherein the signal processing circuitry outputs the low frequency signal extracted in the low frequency signal extraction circuitry, in the form of a plane wave, from the at least two speakers using the wavefront synthesis playback.

4. The audio signal playback device according to claim 1, wherein the multi-channel input audio signal is a multi-channel playback input audio signal, which includes 3 or more channels, and the signal processing circuitry performs discrete Fourier transform on 2 channel audio signals that result from down-mixing the multi-channel input audio signal to the 2 channel audio signals.

5. The audio signal playback device according to claim 2, wherein the multi-channel input audio signal is a multi-channel playback input audio signal, which includes 3 or more channels, and the signal processing circuitry performs discrete Fourier transform on 2 channel audio signals that result from down-mixing the multi-channel input audio signal to the 2 channel audio signals.

6. The audio signal playback device according to claim 3, wherein the multi-channel input audio signal is a multi-channel playback input audio signal, which includes 3 or more channels, and the signal processing circuitry performs discrete Fourier transform on 2 channel audio signals that result from down-mixing the multi-channel input audio signal to the 2 channel audio signals.

7. An audio signal playback method of playing back a multi-channel input audio signal with a speaker group of a speaker array including at least two speakers, using a wavefront synthesis playback, the method comprising:

signal processing, using signal processor circuitry, on each of a 2 or more channel audio signals obtained from the multi-channel input audio signal;

extracting, using low frequency extracting circuitry, a low frequency signal of a correlation signal with a lower frequency than a predetermined frequency from the 2 or more channel audio signals; and outputting the low frequency signal of the correlation signal from the at least two speakers of the speaker array and outputting the low frequency signal of the correlation signal such that a time difference in sound output between adjacent speakers of the at least two speakers is equal to or less than $2\Delta x/c$, where $\Delta x$ is a distance between the adjacent speakers, and c is the speed of sound.

8. A non-transitory computer-readable recording medium including a program for causing a computer to perform an audio signal playback processing that plays back a multi-channel input audio signal with a speaker group of, a speaker array including at least two speakers, using a wavefront synthesis playback, the computer is caused to perform:

signal processing on each of a 2 or more channel audio signals obtained from the multi-channel input audio signal;

extracting a low frequency signal of a correlation signal with a lower frequency than a predetermined frequency from the 2 or more channel audio signals; and outputting the low frequency signal of the correlation signal from the at least two speakers of the speaker array and outputting the low frequency signal of the correlation signal such that a time difference in sound output between adjacent speakers of the at least two speakers is equal to or less than $2\Delta x/c$, where $\Delta x$ is a distance between the adjacent speakers, and c is the speed of sound.

9. The audio signal playback device according to claim 1, wherein gains of the at least two speakers are equal for the low frequency signal of the correlation signal.

10. The audio signal playback device according to claim 1, wherein synthesizing a wavefront of the low frequency signal of the correlation signal is different from synthesizing a wavefront of a non-correlation signal and a wavefront of a non-low frequency signal of the correlation signal and has a frequency equal to or higher than the predetermined frequency.

11. The audio signal playback device according to claim 10, wherein gains of the at least two speakers are equal for the low frequency signal of the correlation signal, and gains are different for the non-correlation signal and the non-low frequency signal of the correlation signal depending on positions of the at least two speakers.

12. The audio signal playback device according to claim 10, wherein the signal processing circuitry outputs the low frequency signal of the correlation signal in a plane wave and outputs the non-correlation signal and the non-low frequency signal of the correlation signal in a non-plane wave.

* * * * *